US010782035B2

(12) United States Patent
Kaneda et al.

(10) Patent No.: US 10,782,035 B2
(45) Date of Patent: Sep. 22, 2020

(54) HEAT EXCHANGER ASSEMBLY AND OUTDOOR UNIT OF REFRIGERATING APPARATUS

(71) Applicant: DAIKIN INDUSTRIES, LTD., Osaka-shi, Osaka (JP)

(72) Inventors: Masahiko Kaneda, Sakai (JP); Eriko Onojima, Settsu (JP); Tomohiro Masui, Sakai (JP); Hideki Sawamizu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 215 days.

(21) Appl. No.: 15/522,075

(22) PCT Filed: Oct. 19, 2015

(86) PCT No.: PCT/JP2015/079418
§ 371 (c)(1),
(2) Date: Apr. 26, 2017

(87) PCT Pub. No.: WO2016/067947
PCT Pub. Date: May 6, 2016

(65) Prior Publication Data

US 2017/0370597 A1 Dec. 28, 2017

(30) Foreign Application Priority Data

Oct. 27, 2014 (JP) ..... 2014-218707

(51) Int. Cl.
*F28F 9/00* (2006.01)
*F24F 1/16* (2011.01)
(Continued)

(52) U.S. Cl.
CPC ..... *F24F 1/16* (2013.01); *F24F 1/18* (2013.01); *F24F 1/34* (2013.01); *F28D 1/053* (2013.01);
(Continued)

(58) Field of Classification Search
CPC ..... F24F 1/08; F24F 1/16; F24F 1/34; F28F 9/002; F28F 9/013; F28F 2225/04; F28F 2225/06; F28F 2225/08
(Continued)

(56) References Cited

U.S. PATENT DOCUMENTS 5,236,042 A * 8/1993 Kado ..... F28F 9/002 165/149
5,487,422 A * 1/1996 Bertva ..... F28F 9/002 165/67
(Continued)

FOREIGN PATENT DOCUMENTS

CN 102197272 A 9/2011
CN 202083248 U 12/2011
(Continued)

OTHER PUBLICATIONS

International Preliminary Report of corresponding PCT Application No. PCT/JP2015/079418 dated May 11, 2017.
(Continued)

*Primary Examiner* — Leonard R Leo
(74) *Attorney, Agent, or Firm* — Global IP Counselors, LLP

(57) ABSTRACT

A heat exchanger assembly includes a header extending in a longitudinal direction, a plurality of heat transfer tubes aligned along the longitudinal direction of the header and connected to the header, a plurality of fins secured to the heat transfer tubes, a first corrective member and a second corrective member. The first corrective member extends along the longitudinal direction of the header on a downstream side of the heat transfer tubes or the header along a direction of an air flow. The second corrective member extends along the longitudinal direction of the header on an upstream side of the heat transfer tubes or the header along the direction of the air flow. A sandwiched object is at least
(Continued)

any one of the heat transfer tubes, the fins, and the header. The sandwiched object is sandwiched by the first and second corrective members.

18 Claims, 25 Drawing Sheets

(51) Int. Cl.

| | |
|---|---|
| ***F28F 9/013*** | (2006.01) |
| ***F28F 9/26*** | (2006.01) |
| ***F24F 1/18*** | (2011.01) |
| ***F28D 1/053*** | (2006.01) |
| ***F24F 1/34*** | (2011.01) |

(52) U.S. Cl.
CPC ..... *F28F 9/00* (2013.01); *F28F 9/013* (2013.01); *F28F 9/26* (2013.01); *F28F 9/002* (2013.01); *F28F 2225/08* (2013.01)

(58) Field of Classification Search
USPC ..... 165/67
See application file for complete search history.

(56) References Cited

U.S. PATENT DOCUMENTS

| | | | | |
|---|---|---|---|---|
| 5,657,817 | A * | 8/1997 | Heine | F28F 9/002 165/67 |
| 6,390,180 | B1 * | 5/2002 | Olsen | F28F 9/002 165/67 |
| 6,527,044 | B2 * | 3/2003 | Mangold | F28F 9/002 165/67 |
| 6,901,992 | B2 * | 6/2005 | Kent | F28F 9/002 165/67 |
| 7,552,757 | B2 * | 6/2009 | Hassdenteufel | F28F 9/002 165/67 |

FOREIGN PATENT DOCUMENTS

| | | | |
|---|---|---|---|
| EP | 2754974 | A2 | 7/2014 |
| JP | 56-76967 | U | 6/1981 |
| JP | 56-96263 | U | 7/1981 |
| JP | 4-120539 | U | 10/1992 |
| JP | 5-87483 | A | 4/1993 |
| JP | 9-202 | U | 4/1997 |
| JP | 2010-91136 | A | 4/2010 |
| JP | 2010-127530 | A | 6/2010 |
| JP | 2010-169357 | A | 8/2010 |
| JP | 2013-137127 | A | 7/2013 |
| JP | 2014-137157 | A | 7/2014 |
| WO | 2010/000311 | A1 | 1/2010 |
| WO | 2013/091095 | A1 | 6/2013 |

OTHER PUBLICATIONS

European Search Report of corresponding EP Application No. 15 85 3789.4 dated Oct. 11, 2017.
International Search Report of corresponding PCT Application No. PCT/JP2015/79418 dated Jan. 19, 2016.

* cited by examiner

HEAT EXCHANGER ASSEMBLY AND OUTDOOR UNIT OF REFRIGERATING APPARATUS

CROSS-REFERENCE TO RELATED APPLICATIONS

This U.S. National stage application claims priority under 35 U.S.C. § 119(a) to Japanese Patent Application No. 2014-218707, filed in Japan on Oct. 27, 2014, the entire contents of which are hereby incorporated herein by reference.

TECHNICAL FIELD

The present invention relates to a heat exchanger assembly and an outdoor unit of a refrigerating apparatus.

BACKGROUND ART

In prior-art air conditioning apparatuses and other refrigerating apparatuses, it has been conventional to use heat exchangers configured with heat radiation fins secured to a plurality of heat transfer tubes, inside of which a refrigerant flows. For example, the heat exchanger disclosed in Japanese Laid-open Patent Publication No. 2010-169357 is provided with a plurality of heat transfer tubes that extend in a horizontal direction and that are aligned vertically, and heat transfer fins secured to these heat transfer tubes. This heat exchanger is configured including end parts on the inlet and outlet sides, and end parts on the side where the heat transfer tubes fold back.

SUMMARY

Technical Problem

In the heat exchanger presented in Japanese Laid-open Patent Publication No. 2010-169357 as described above, there are sometimes individual differences in the shapes and/or dimensions of the heat transfer tubes during manufacture.

When individual differences among the heat transfer tubes are thus presented, there is a risk that there will be warping in the heat exchanger itself, and that it will be difficult to arrange the heat exchanger in the intended location. For example, there is a risk that in an overhead view, one end of the heat exchanger bends to the downstream side of the air flow or the upstream side of the air flow, or that, when the heat exchanger is bent into an L-shape, the bending will not be sufficient for the intended shape to be assumed, or that the bending will be excessive. Particularly, such warping is more likely to occur when the effective length of the heat transfer tubes at the same height is increased in order to expand the effective range (heat transfer area) of heat exchange in the heat exchanger.

In cases in which the heat exchanger is bent and the degree of bending cannot be fully adjusted, there is a risk that the degree of bending not being to the intended degree or that there will be warping in the heat exchanger itself due to the center of gravity deviating from the intended position; thereby the orientation of the heat exchanger will be such that the upper portion thereof leans in toward the downstream side of the air flow or the upstream side of the air flow or that the lower portion thereof warps somewhat toward the downstream side of the air flow or the upstream side of the air flow. Such warpage is more likely to occur particularly in cases in which the number of vertically aligned heat transfer tubes is increased in order to expand the effective range (heat transfer area) of heat exchange in the heat exchanger.

Not only in the case of heat exchangers in which heat transfer tubes are aligned in a single row as seen in an overhead view as described above, but also in, e.g., heat exchangers in which heat transfer tubes are aligned in two rows on the downstream side of the air flow or the upstream side of the air flow as seen in an overhead view, as well as heat exchangers in which heat transfer tubes are aligned in three or more rows, there is a risk of the distance between rows varying as a result of a difference in the degree of warpage between rows. For example, there is a risk that, e.g., the distance between rows as seen in an overhead view will increase, or that the distance between rows will be too small.

The present invention was contrived in view of the matters described above, it being an object of the present invention to provide a heat exchanger assembly and an outdoor unit of a refrigerating apparatus in which warping of the heat exchanger can be suppressed.

Solution to Problem

A heat exchanger assembly according to a first aspect comprises a header extending in a longitudinal direction, a plurality of heat transfer tubes, a plurality of fins, a first corrective member, and a second corrective member. The plurality of heat transfer tubes are aligned along the longitudinal direction of the header, and are connected to the header. The plurality of fins are secured to the heat transfer tubes. The first corrective member extends along the longitudinal direction of the header on a downstream side of the air flow of the heat transfer tubes or the header. The second corrective member extends along the longitudinal direction of the header on an upstream side of the air flow of the heat transfer tubes or the header. A sandwiched object, which is at least any one of the heat transfer tubes, the fins, and the header, are sandwiched by the first corrective member and the second corrective member.

In this aspect, the term "sandwich" includes not only cases of enclosure with direct contact, but also cases of indirect enclosure without direct contact. Specifically, an interposed member may be placed between: the first corrective member and/or the second corrective member; and the heat transfer tubes, the fins, and/or the header.

The object or objects sandwiched by the first corrective member and the second corrective member may be the heat transfer tubes alone, the fins alone, the header alone, the heat transfer tubes and the fins together, the heat transfer tubes and the header together, or the header and the fins together. When the heat transfer tubes and the fins together are sandwiched, for example, the first corrective member may be in contact with the heat transfer tubes while the second corrective member is in contact with the fins, or the first corrective member may be in contact with the fins while the second corrective member is in contact with the heat transfer tubes. When the heat transfer tubes and the header together are sandwiched, for example, the first corrective member may be in contact with the heat transfer tubes while the second corrective member is in contact with the header, or the first corrective member may be in contact with the header while the second corrective member is in contact with the heat transfer tubes. When the header and the fins together are sandwiched, for example, the first corrective member may be in contact with the header while the second corrective member is in contact with the fins, or the first corrective member may be in contact with the fins while the second corrective member is in contact with the header.

In this heat exchanger assembly, even when individual differences arise during manufacture of the plurality of heat transfer tubes, warpage of the heat exchanger can be suppressed by using the first corrective member and the second corrective member to sandwich the sandwiched object, which is at least any one of the heat transfer tubes, the fins, and/or the header.

A heat exchanger assembly according to a second aspect is the heat exchanger assembly according to the first aspect, further comprising a buffer member, at least part of which is interposed between the first corrective member and the sandwiched object, and/or between the second corrective member and the sandwiched object. The buffer member is not particularly limited as long as it is able to lessen and soften impact between the first corrective member and the sandwiched object, and/or impact between the second corrective member and the sandwiched object. For example, rubber, foamed styrene, bubble wrap, etc., are possible materials. The buffer member may be interposed in part of the space between the first corrective member and the sandwiched object and/or between the second corrective member and the sandwiched object, or the buffer member may be interposed in the entire space. The material and/or thickness of the buffer member, which depend on their location, is arbitrary; the material of the buffer member may be the same or different from one specific location to another, and the thickness of the buffer member may be the same or different.

In this heat exchanger assembly, the sandwiched object can be more stably sandwiched by interposing the buffer member between the first corrective member and the sandwiched object and between the second corrective member and the sandwiched object.

A heat exchanger assembly according to a third aspect is the heat exchanger assembly according to the second aspect, wherein the first corrective member and the second corrective member are configured from a metal different from that used for the sandwiched object. The buffer member is insulative. In this aspect, the first corrective member and the sandwiched object may be configured from different metals while the second corrective member and the sandwiched object is configured from a different metal, or the first corrective member and the second corrective member may be configured from the same metal or a different metal.

In this heat exchanger assembly, the buffer member interposed between the first corrective member and the sandwiched object and between the second corrective member and the sandwiched object is able not only to lessen and soften impact between the first corrective member and the sandwiched object and/or impact between the second corrective member and the sandwiched object, but also to prevent electrical corrosion between these components.

A heat exchanger assembly according to a fourth aspect is the heat exchanger assembly according to the first or second aspect, further comprising an insulative member, at least part of which is interposed between the first corrective member and the sandwiched object, and/or between the second corrective member and the sandwiched object. The first corrective member and the second corrective member are configured from a metal different from that used for the sandwiched object. The insulative member is not particularly limited as long as their insulation lets through no substantial amount of electricity, and the insulative member needs not be elastic, examples thereof including, but not being limited to, glass. Additionally, as long as the insulative member can separate the first corrective member and the sandwiched object each other, and/or the second corrective member and the sandwiched object each other, the insulative member may be interposed in at least part of the space between the first corrective member and the sandwiched object and between the second corrective member and the sandwiched object, and the insulative member may also be interposed in the entire space. The material and/or thickness of the insulative member, which depend on their location, is arbitrary; the material of the insulative member may be the same or different from one specific location to another, and the thickness of the insulative member may be the same or different.

In this heat exchanger assembly, electrical corrosion can be prevented while suppressing warpage of the heat exchanger even when the heat transfer tubes are configured from a metal different from that used for the first corrective member and/or the second corrective member.

A heat exchanger assembly according to a fifth aspect is the heat exchanger assembly according to any of the first through fourth aspects, wherein the heat transfer tubes include a first-row heat transfer tube group and a second-row heat transfer tube group disposed so as to be aligned in a front-to-back direction. The first corrective member and the second corrective member cooperate so as to suppress the front-to-back-direction separation between the first-row heat transfer tube group and the second-row heat transfer tube group.

In this heat exchanger assembly, it is possible to suppress the front-to-back-direction separation between the first-row heat transfer tube group and the second-row heat transfer tube group in the end part on the side where the first corrective member and the second corrective member are provided, even in cases in which the first-row heat transfer tube group and the second-row heat transfer tube group are collected up in the end part on the side opposite the side where the first corrective member and the second corrective member are provided.

A heat exchanger assembly according to a sixth aspect is the heat exchanger assembly according to any of the first through fifth aspects, wherein the heat transfer tubes are flat tubes. In this aspect, the direction in which the flat tubes are flattened (the thickness direction of the thinned portions) is not particularly limited, and may be the vertical direction or the front-to-back direction. Additionally, the direction in which the heat transfer tubes extend from the header is not particularly limited, but the heat transfer tubes may, e.g., extend in a horizontal direction relative to the header.

In this heat exchanger assembly, warpage of the heat exchanger can be suppressed even when the heat transfer tubes are configured from flat tubes that are more susceptible to warpage than cylindrical tubes.

An outdoor unit of a refrigerating apparatus according to a seventh aspect comprises the heat exchanger assembly according to any of the first through sixth aspects, and a casing.

The casing has a bottom frame and accommodates the heat exchanger assembly. At least one of the first corrective member and the second corrective member is secured to the bottom frame, either directly or indirectly via an interposed member, whereby the heat exchanger assembly is secured to the casing.

In this outdoor unit of a refrigerating apparatus, the heat exchanger assembly can be secured to the bottom frame using either one of the first corrective member and the second corrective member, which enclose the heat exchanger throughout the longitudinal direction from both the upstream and downstream sides of the air. Therefore, the heat exchanger can be more stably secured.

An outdoor unit of a refrigerating apparatus according to an eighth aspect comprises the heat exchanger assembly according to any of the first through sixth aspects, and a casing which accommodates the heat exchanger assembly. The first corrective member and the second corrective member have a warpage-suppressing portion for sandwiching the sandwiched object, and a securing part for securing the first corrective member and the second corrective member to a secured part. The secured part is either the casing or an interposed member secured to the casing in the interior of the casing. The warpage-suppressing portion has a convex part that protrudes toward the sandwiched object side.

In this outdoor unit of a refrigerating apparatus, the first corrective member and the second corrective member, one of which is secured to the casing or to the secured part of the interposed member, can sandwich the sandwiched object of the heat exchanger by the warpage-suppressing portion having a convex part that protrude toward the sandwiched object side. Therefore, the sandwiched object of the heat exchanger can be more sufficiently sandwiched by the first corrective member and the second corrective member, and the effect of suppressing heat exchanger warpage can be further increased.

Advantageous Effects of Invention

In the heat exchanger assembly according to the first aspect, warpage of the heat exchanger can be suppressed even when individual differences occur during manufacture of the plurality of heat transfer tubes.

In the heat exchanger assembly according to the second aspect, the sandwiched object can be more stably sandwiched.

In the heat exchanger assembly according to the third aspect, impact can be lessened and electrical corrosion can be prevented.

In the heat exchanger assembly according to the fourth aspect, electrical corrosion can be prevented while suppressing warpage of the heat exchanger.

In the heat exchanger assembly according to the fifth aspect, the front-to-back-direction separation between the first-row heat transfer tube group and the second-row heat transfer tube group can be suppressed.

In the heat exchanger assembly according to the sixth aspect, warpage of the heat exchanger can be suppressed even when the heat transfer tubes are configured from flat tubes.

In the outdoor unit of a refrigerating apparatus according to the seventh aspect, the heat exchanger can be more stably secured.

In the outdoor unit according to the eighth aspect, the effect of suppressing heat exchanger warpage can be further increased.

DESCRIPTION OF EMBODIMENTS

(1) Overall Configuration of Air Conditioning Apparatus 1

Figure 1:
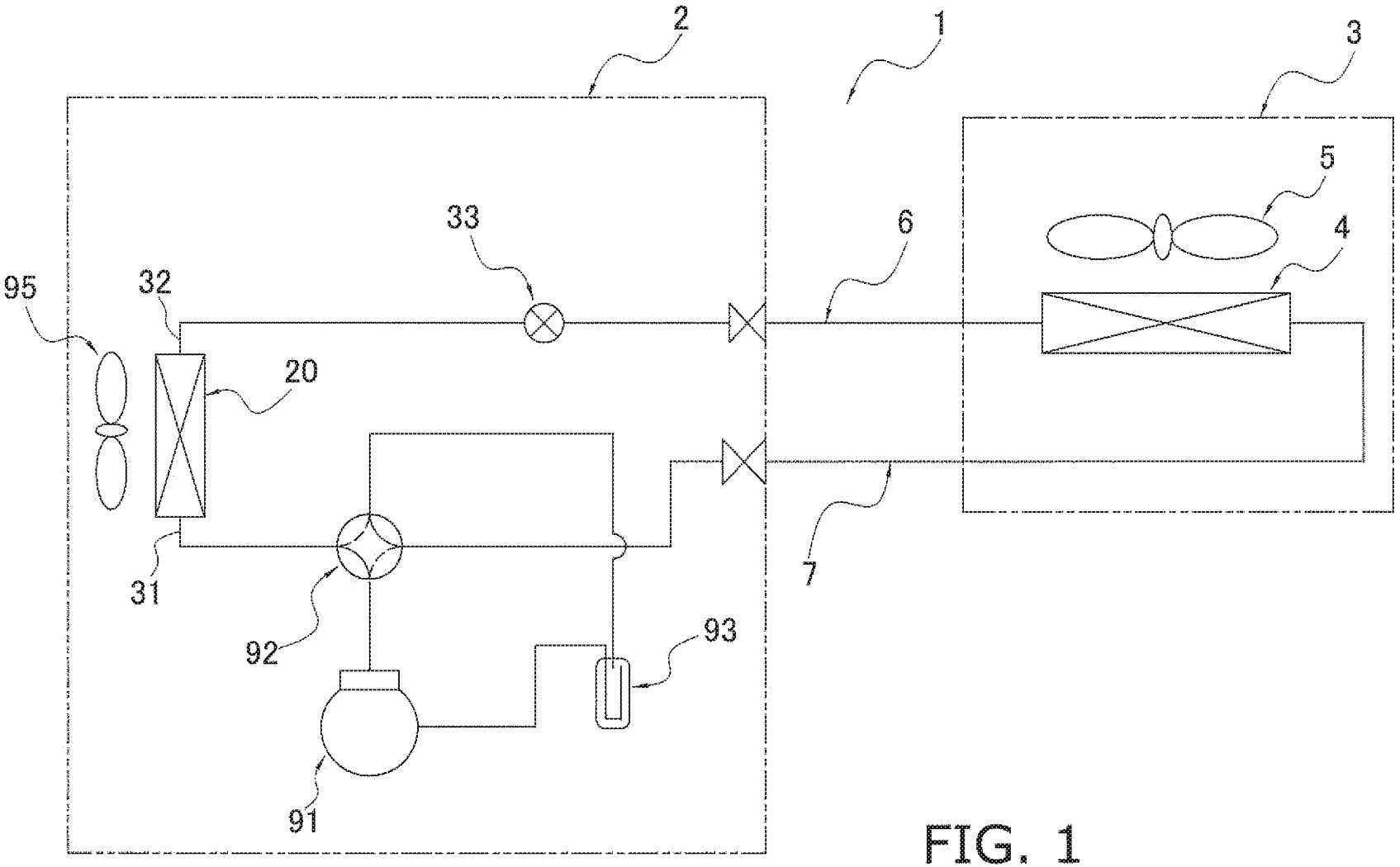
FIG. 1 is a circuit diagram of overview of the scheme of an air conditioning apparatus according to a first embodiment.

FIG. 1 is a circuit diagram showing a schema of the configuration of an air conditioning apparatus 1, which is an example of a refrigerating apparatus according to one embodiment of the present invention.

This air conditioning apparatus 1 is a device used for cooling and heating, through vapor compression refrigerating cycle operation, of a building interior in which an air conditioning indoor unit 3 has been installed, and is configured by an air conditioning outdoor unit 2 as a heat source-side unit and the air conditioning indoor unit 3 as a usage-side unit, which are connected by refrigerant interconnecting pipelines 6, 7.

The refrigerant circuit configured by connection of the air conditioning outdoor unit 2, the air conditioning indoor unit 3, and the refrigerant interconnecting pipelines 6, 7 is further configured by connecting a compressor 91, a four-way switching valve 92, an outdoor heat exchanger 20, an expansion valve 33, an indoor heat exchanger 4, an accumulator 93, and the like, through refrigerant pipelines. A refrigerant is sealed within this refrigerant circuit, and refrigerating cycle operation involving compression, cooling, depressurization, and heating/evaporation of the refrigerant, followed by re-compression, is carried out. As the refrigerant, there may be employed one selected, for example, from R410A, R32, R407C, R22, R134a, and the like.

(2) Detailed Configuration of Air Conditioning Apparatus 1

(2-1) Air Conditioning Indoor Unit 3

The air conditioning indoor unit 3 is installed by being wall-mounted on an indoor wall or the like, or by being recessed within or suspended from an indoor ceiling of a building or the like. The air conditioning indoor unit 3 includes the indoor heat exchanger 4 and an indoor fan 5. The indoor heat exchanger 4 is, for example, a fin-and-tube heat exchanger of cross fin type, configured by a heat transfer tube and a multitude of fins. In an air-cooling operation, the heat exchanger functions as an evaporator for the refrigerant to cool the indoor air, and in an air-warming operation functions as a condenser for the refrigerant to heat the indoor air.

(2-2) Air Conditioning Outdoor Unit 2

Figure 2:
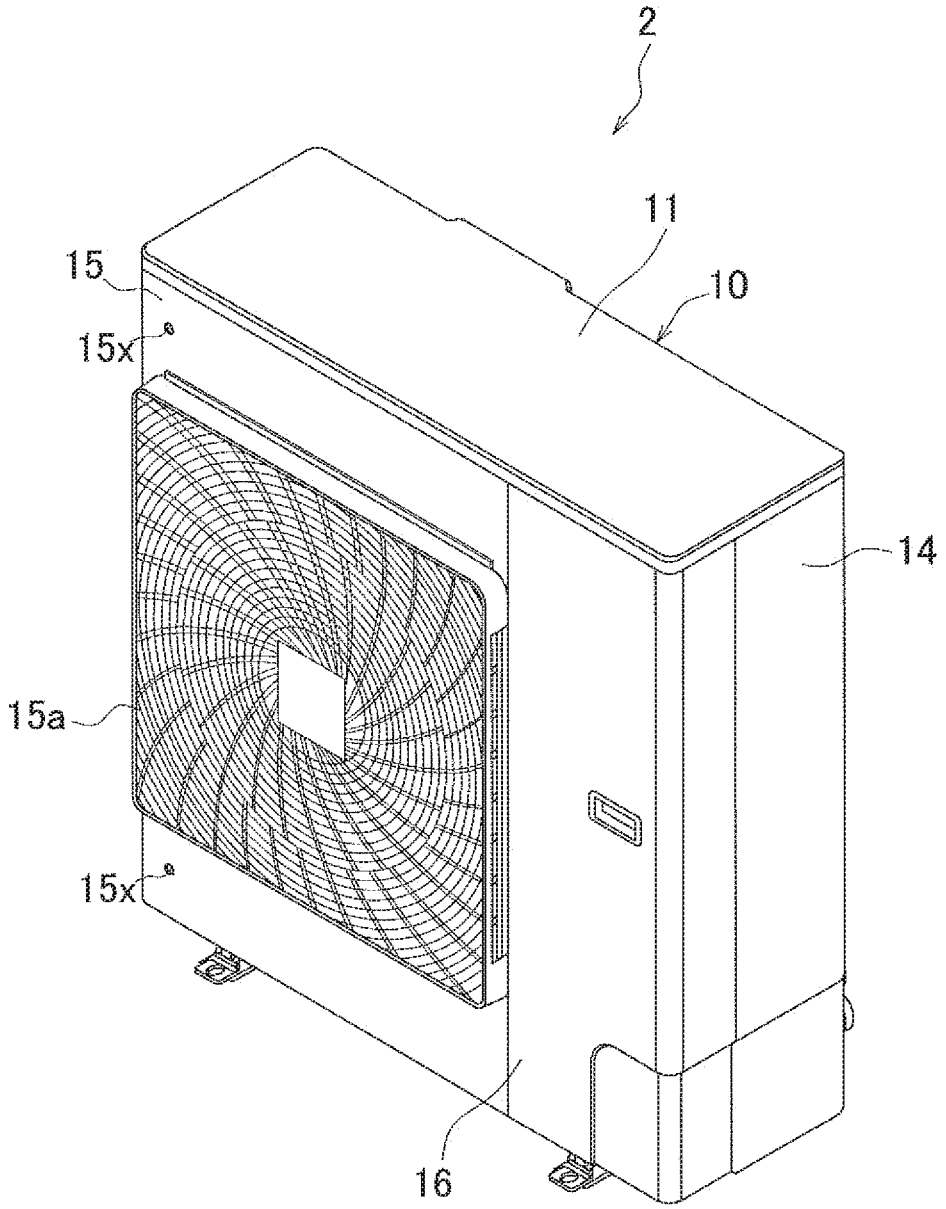
FIG. 2 is a perspective view of the exterior of an air conditioning outdoor unit.
Figure 3:
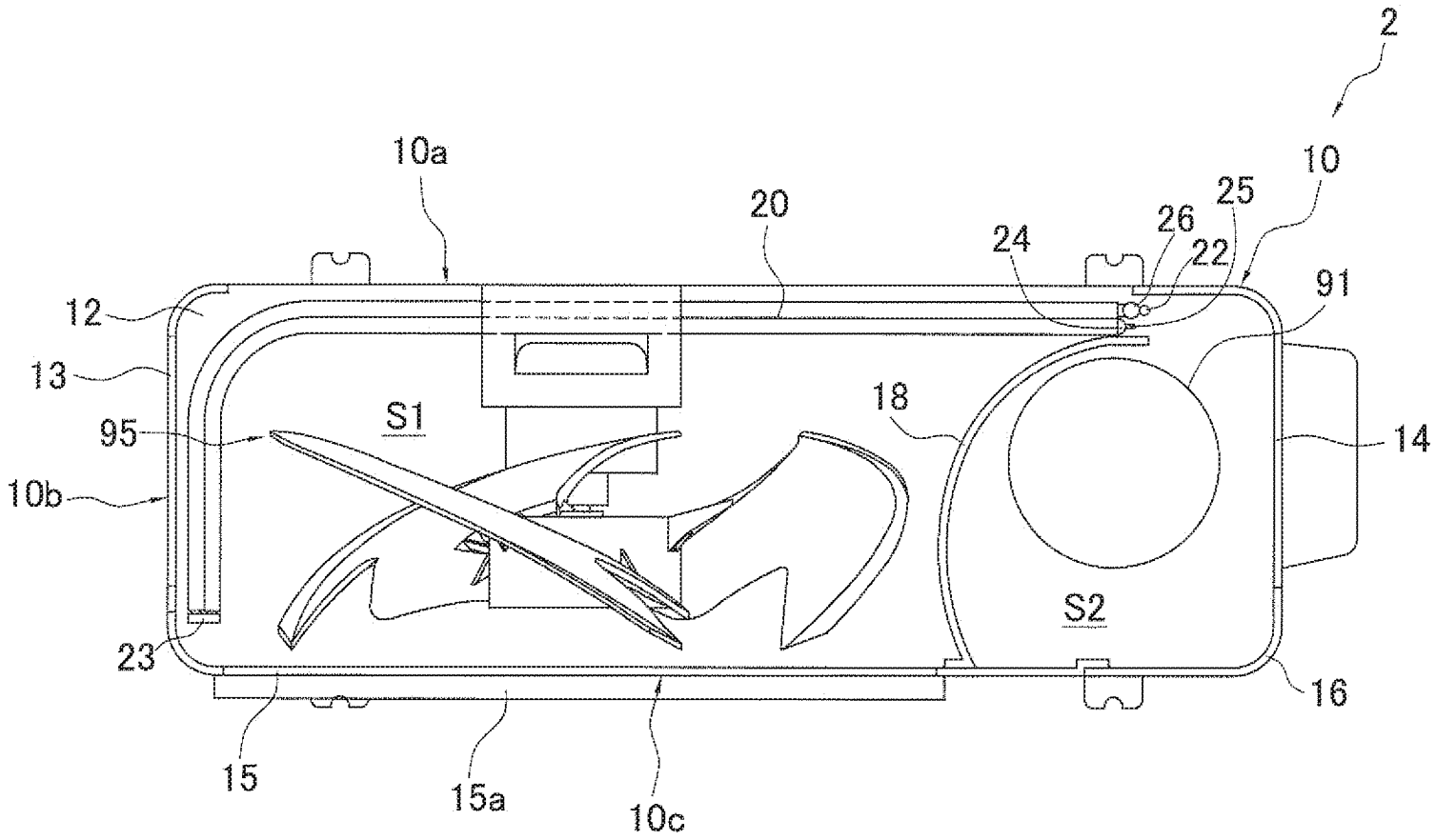
FIG. 3 is a schematic plan view illustrating the arrangement of devices in an the air conditioning outdoor unit.

The air conditioning outdoor unit 2 is installed outside a building or the like, and is connected to the air conditioning indoor unit 3 by the refrigerant interconnecting pipelines 6, 7. As shown in FIG. 2 and FIG. 3, the air conditioning outdoor unit 2 has a unit casing 10 of substantially cuboid shape.

As shown in FIG. 3, the air conditioning outdoor unit 2 has a structure (a "trunk" type structure) in which a blower chamber S1 and a machinery chamber S2 are formed by dividing an internal space of the unit casing 10 into two by a partition panel 18 that extends in a vertical direction. The air conditioning outdoor unit 2 includes an outdoor heat exchanger 20 and an outdoor fan 95 which are arranged within the blower chamber S1 of the unit casing 10, and also includes the compressor 91, the four-way switching valve 92, the accumulator 93, the expansion valve 33, a gas refrigerant pipeline 31, and a liquid refrigerant pipeline 32 which are arranged within the machinery chamber S2 of the unit casing 10.

The unit casing 10 configures a casing provided with a bottom frame 12, a top panel 11, a side panel 13 at the blower chamber side, a side panel 14 at the machinery chamber side, a blower chamber-side front panel 15, and a machinery chamber-side front panel 16. The bottom frame 12, the top panel 11, the side panel 13 at the blower chamber side, the side panel 14 at the machinery chamber side, the blower chamber-side front panel 15, and the machinery chamber-side front panel 16, which configure the unit casing 10, are each configured by the same type of metal or different types of metals other than aluminum and aluminum alloys, and in the present embodiment, an alloy configured with iron as the main component is used. The surfaces of these metals may be plated, in which case they are plated by a metal other than aluminum and aluminum alloys.

The direction of a line normal to the plane over which the blower chamber-side front panel 15 and the machinery chamber-side front panel 16 broaden, and the orientation of the side of the blower chamber-side front panel 15 and the machinery chamber-side front panel 16 that is opposite the interior of the unit casing 10, is referred to below as the "front," and the opposite side thereof is referred to as the "rear," unless otherwise indicated. The terms "left," "right," "upper," and "lower" all refer to orientations in the air conditioning apparatus when the apparatus has been installed and is viewed from the front side.

Figure 6:
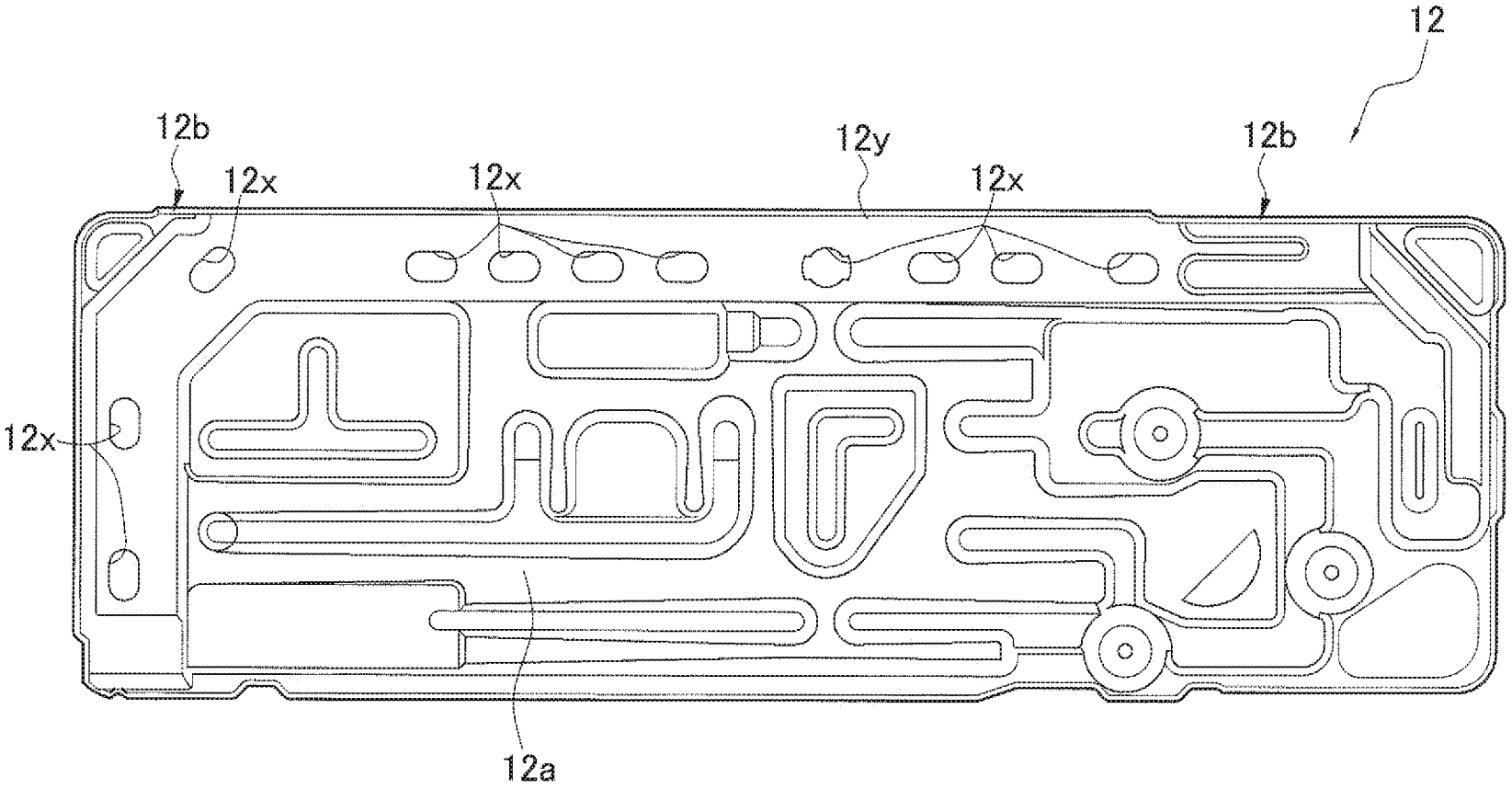
FIG. 6 is a schematic configuration diagram in plan view of a bottom frame.

The bottom frame 12 has, as shown in FIG. 6, which is a plan-view schematic configuration diagram of the bottom frame, a bottom portion 12*a* configuring the bottom of the unit casing 10, and a side-wall portion 12*b* provided so as to stand upright at a peripheral edge of the bottom portion 12*a*. The side panel 13 at the blower chamber side, the side panel 14 at the machinery chamber side, the blower chamber-side front panel 15, and the machinery chamber-side front panel 16 are all screwed or otherwise secured at the lower-end portions, in a state of surface contact with the outer side of the side-wall portion 12*b* of the bottom frame 12.

The air conditioning outdoor unit 2 is configured in such a way that outdoor air is drawn into the blower chamber S1 within the unit casing 10 from parts of the rear surface and the side surface of the unit casing 10, and the drawn outdoor air is vented from the front surface of the unit casing 10. In specific terms, an intake port 10*a* and an intake port 10*b* facing the blower chamber S1 within the unit casing 10 are formed between the rear face-side end of the side panel 13 on the blower chamber side and the blower chamber S1-side end of the side panel 14 at the machinery chamber side. The blower chamber-side front panel 15 is furnished with a vent 10*c*, the front side thereof being covered by a fan grill 15*a*.

The compressor 91 is, for example, a sealed compressor driven by a compressor motor, and is configured such that the operating capacity can be varied through inverter control.

The four-way switching valve 92 is a mechanism for switching the direction of flow of the refrigerant. In the air-cooling operation, the four-way switching valve 92 connects a refrigerant pipeline at the discharge side of the compressor 91 and the gas refrigerant pipeline 31 which extends from an one end (the gas-side end) of the outdoor heat exchanger 20, as well as connecting, via the accumulator 93, the refrigerant interconnecting pipeline 7 for the gas refrigerant and the refrigerant pipeline at the intake side of the compressor 91 (see the solid lines of the four-way switching valve 92 in FIG. 1). In the air-warming operation, the four-way switching valve 92 connects the refrigerant pipeline at the discharge side of the compressor 91 and the refrigerant interconnecting pipeline 7 for the gas refrigerant, as well as connecting, via the accumulator 93, the intake side of the compressor 91 and the gas refrigerant pipeline 31 which extends from the one end (the gas-side end) of the outdoor heat exchanger 20 (see the broken lines of the four-way switching valve 92 in FIG. 1).

The outdoor heat exchanger 20 is arranged upright in a vertical direction (vertical direction) in the blower chamber S1, and faces the intake ports 10*a*, 10*b*. The outdoor heat exchanger 20 is a heat exchanger made of aluminum; in the present embodiment, one having design pressure of about 3-4 MPa is employed. The gas refrigerant pipeline 31 extends from the one end (the gas-side end) of the outdoor heat exchanger 20, so as to connect to the four-way switching valve 92. The liquid refrigerant pipeline 32 extends from the other end (the liquid-side end) of the outdoor heat exchanger 20, so as to connect to the expansion valve 33.

The accumulator 93 is connected between the four-way switching valve 92 and the compressor 91. The accumulator 93 is equipped with a gas-liquid separation function for separating the refrigerant into a gas phase and a liquid phase. Refrigerant inflowing to the accumulator 93 is separated into the gas phase and the liquid phase, and the gas phase refrigerant which collects in the upper spaces is supplied to the compressor 91.

The outdoor fan 95 supplies the outdoor heat exchanger 20 with outdoor air for heat exchange with the refrigerant flowing through the outdoor heat exchanger 20.

The expansion valve 33 is a mechanism for depressurizing the refrigerant in the refrigerant circuit, and is an electrically-operated valve, the opening degree of which is adjustable. In order to regulate the refrigerant pressure and the refrigerant flow rate, the expansion valve 33 is disposed between the outdoor heat exchanger 20 and the refrigerant interconnecting pipeline 6 for the liquid refrigerant, and has the function of expanding the refrigerant, both in the air-cooling operation and air-warming operation.

The outdoor fan 95 is arranged facing the outdoor heat exchanger 20 in the blower chamber S1. The outdoor fan 95 draws outdoor air into the unit, and after heat exchange between the outdoor air and the refrigerant has taken place in the outdoor heat exchanger 20, discharges the heat-exchanged air to the outdoors. This outdoor fan 95 is a fan in which it is possible to adjust the airflow volume of the air supplied to the outdoor heat exchanger 20, and could be, for example, a propeller fan driven by a motor, such as a DC fan motor, or the like.

(3) Operation of Air Conditioning Apparatus 1

(3-1) Air-Cooling Operation

In the air-cooling operation, the four-way switching valve 92 enters the state shown by the solid lines in FIG. 1, i.e., a state in which the discharge side of the compressor 91 is connected to the gas side of the outdoor heat exchanger 20 via the gas refrigerant pipeline 31, and the intake side of the compressor 91 is connected to the gas side of the indoor heat exchanger 4 via the accumulator 93 and the refrigerant interconnecting pipeline 7. The opening degree of the expansion valve 33 is regulated so that either the degree of superheating of the refrigerant in the outlet of the indoor heat exchanger 4 (i.e., the gas side of the indoor heat exchanger 4) or the degree of supercooling in the outlet of the outdoor heat exchanger 20 (i.e., the liquid side of the outdoor heat exchanger 20) is constant. With the refrigerant circuit in this state, when the compressor 91, the outdoor fan 95, and the indoor fan 5 are run, low-pressure gas refrigerant is compressed by the compressor 91 to become high-pressure gas refrigerant. This high-pressure gas refrigerant is fed to the outdoor heat exchanger 20 through the four-way switching valve 92. Subsequently, the high-pressure gas refrigerant undergoes heat exchange in the outdoor heat exchanger 20 with outdoor air supplied by the outdoor fan 95, and is condensed to become high-pressure liquid refrigerant. The high-pressure liquid refrigerant, now in a supercooled state, is fed to the expansion valve 33 from the outdoor heat exchanger 20. Refrigerant having been depressurized to close to the intake pressure of the compressor 91 by the expansion valve 33 and entered a low-pressure, gas-liquid two-phase state is fed to the indoor heat exchanger 4, and undergoes heat exchange with indoor air in the indoor heat exchanger 4, evaporating to become low-pressure gas refrigerant.

This low-pressure gas refrigerant is fed to the air conditioning outdoor unit 2 through the refrigerant interconnecting pipeline 7, and is again drawn into the compressor 91. In this air-cooling operation, the air conditioning apparatus 1 prompts the outdoor heat exchanger 20 to function as a condenser for the refrigerant compressed in the compressor 91, and the indoor heat exchanger 4 to function as an evaporator for the refrigerant condensed in the outdoor heat exchanger 20.

In the refrigerant circuit during the air-cooling operation, while degree of superheating control of the expansion valve 33 is being performed, the compressor 91 is inverter-controlled so that the set temperature is achieved (so as to be able to handle the air-cooling load).

(3-2) Air-Warming Operation

In the air-warming operation, the four-way switching valve 92 enters the state shown by broken lines in FIG. 1, i.e., a state in which the discharge side of the compressor 91 is connected to the gas side of the indoor heat exchanger 4 via the refrigerant interconnecting pipeline 7, and the intake side of the compressor 91 is connected to the gas side of the outdoor heat exchanger 20 via the gas refrigerant pipeline 31. The design of the expansion valve 33 is such that the opening degree is regulated to maintain the degree of supercooling of the refrigerant at the outlet of the indoor heat exchanger 4 at a target value of degree of supercooling (degree of supercooling control). With the refrigerant circuit in this state, when the compressor 91, the outdoor fan 95, and the indoor fan 5 are run, low-pressure gas refrigerant is drawn in and compressed by the compressor 91 to become high-pressure gas refrigerant, and is fed to the air conditioning indoor unit 3 through the four-way switching valve 92 and the refrigerant interconnecting pipeline 7.

The high-pressure gas refrigerant fed to the air conditioning indoor unit 3 then undergoes heat exchange with indoor air in the indoor heat exchanger 4, and is condensed to become high-pressure liquid refrigerant, then while passing through the expansion valve 33 is depressurized to an extent commensurate with the opening degree of the expansion valve 33. The refrigerant having passed through the expansion valve 33 flows into the outdoor heat exchanger 20. The refrigerant in a low-pressure, gas-liquid two-phase state having flowed into the outdoor heat exchanger 20 undergoes heat exchange with outdoor air supplied by the outdoor fan 95, evaporates to become low-pressure gas refrigerant, and is again drawn into the compressor 91 through the four-way switching valve 92. In this air-warming operation, the air conditioning apparatus 1 prompts the indoor heat exchanger 4 to function as a condenser for the refrigerant compressed in the compressor 91, and the outdoor heat exchanger 20 to function as an evaporator for the refrigerant condensed in the indoor heat exchanger 4.

In the refrigerant circuit during the air-warming operation, while degree of supercooling control of the expansion valve 33 is being performed, the compressor 91 is inverter-controlled so that the set temperature is achieved (so as to be able to handle the air-warming load).

(4) Detailed Configuration of the Outdoor Heat Exchanger 20

Figure 4:
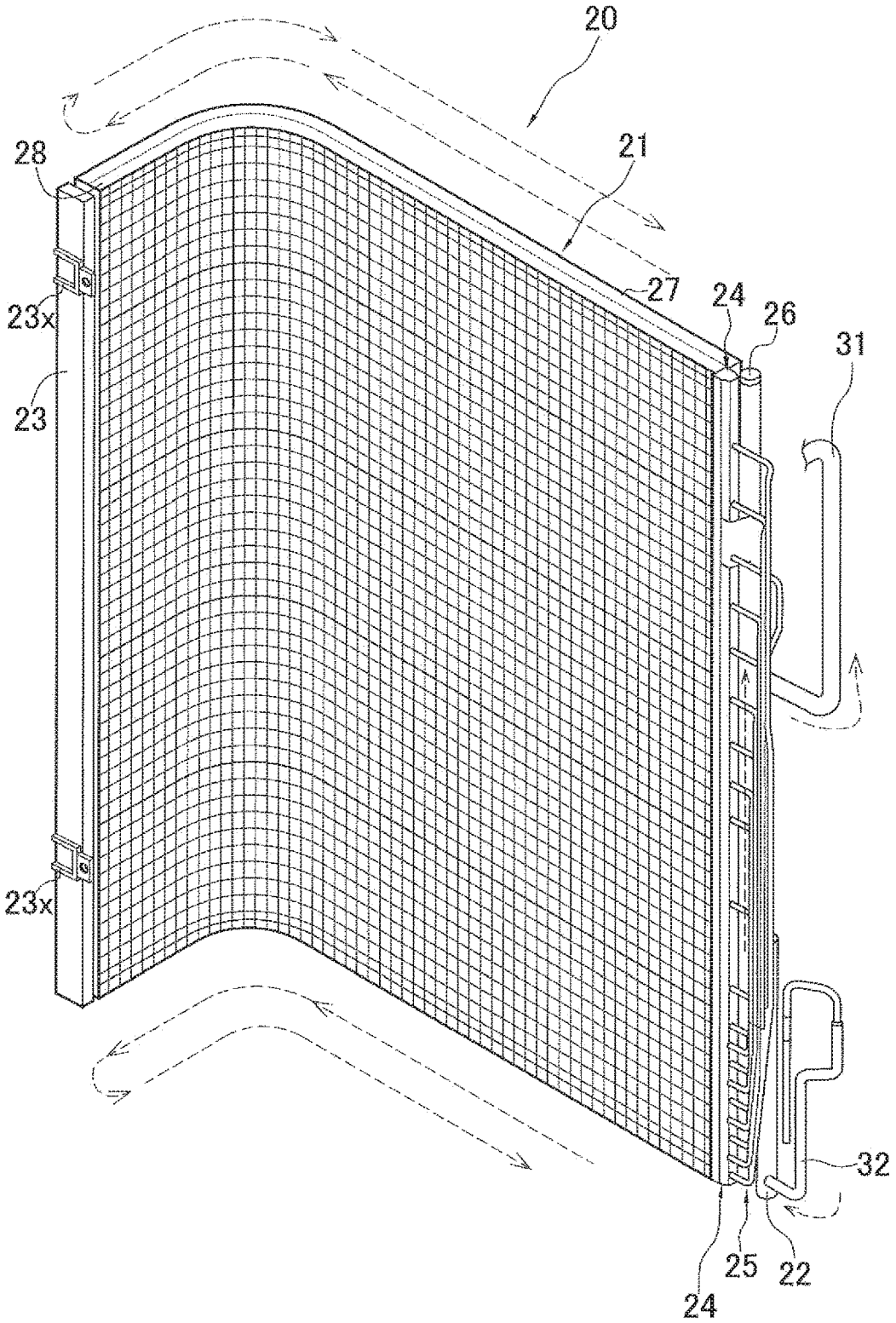
FIG. 4 is a schematic external perspective view of an outdoor heat exchanger.
Figure 5:
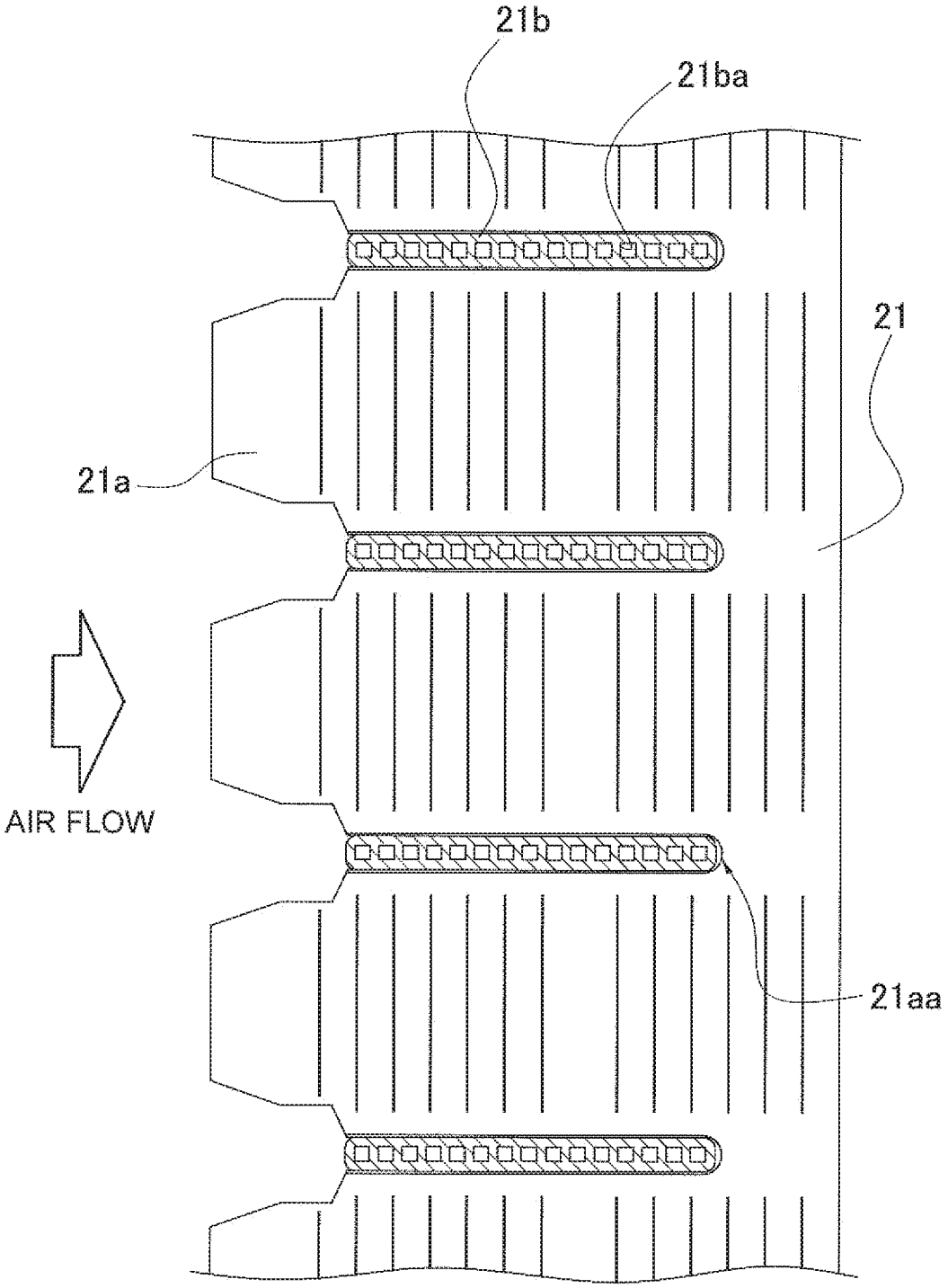
FIG. 5 is a schematic cross-sectional view showing heat transfer fins as being attached to flat multi-perforated tubes in an outdoor heat exchanger.

FIG. 4 is a schematic exterior perspective view of the outdoor heat exchanger 20. FIG. 5 shows a state of attachment of heat transfer fins 21*a* to flat multi-perforated tubes 21*b*.

The outdoor heat exchanger 20 is provided with a heat exchange part 21 in which heat is exchanged between the outside air and the refrigerant, an outlet/inlet header collecting tube 26 and a folding-back header 24 provided to a one end of the heat exchange part 21, a connecting header 23 provided to the other end of the heat exchange part 21, an interconnecting part 25 for interconnecting the lower part of the folding-back header 24 and the upper part of the folding-back header 24, and a diverter 22 for guiding refrigerant that has been diverted below the outlet/inlet header collecting tube 26.

Each of the members configuring the outdoor heat exchanger 20 may be configured by different metals but in the present embodiment, the members are all made of aluminum or an aluminum alloy.

The heat exchange part 21 is configured by a multitude of the heat transfer fins 21*a* and a multitude of the flat multi-perforated tubes 21*b*. The heat transfer fins 21*a* are flat members, and a plurality of cutouts 21*aa* extending in a horizontal direction for insertion of flattened tubes are formed side by side in a vertical direction in each of the heat transfer fins 21*a*. The heat transfer fins 21*a* are attached so as to have innumerable sections protruding towards the upstream side of the air flow.

The flat multi-perforated tubes 21*b* function as heat transfer tubes and for transfer heat moving between the heat transfer fins 21*a* and the outside air to the refrigerant flowing through the interior. The flat multi-perforated tubes 21*b* have upper and lower flat surfaces serving as heat transfer surfaces, and a plurality of intake ports 21*ba* through which the refrigerant flows. A plurality of flat multi-perforated tubes 21*b* having this configuration are provided, and are arranged at prescribed intervals in the vertical direction. Although no particular limitation is provided, the flat multi-perforated tubes 21*b* having the plurality of intake ports 21*ba* are preferably manufactured by being extruded in a longitudinal direction. The curved section of the heat exchange part 21, described hereinafter, can be formed by curving the flat multi-perforated tubes 21*b* thus obtained by extrusion. The plurality of cutouts 21*aa* of the heat transfer fins 21*a* described above are respectively fitted into the plurality of flat multi-perforated tubes 21*b* as shown in FIG. 5, and the heat transfer fins 21*a* are thereby secured by brazing.

With respect to the direction of the air flow created by the outdoor fan 95 (the flow moving from the back surface and left-side surface of the casing toward the fan grill 15*a* on the front surface of the casing), the heat exchange part 21 has an upstream-side of the air flow heat exchange part 27 provided so as to border on the upstream side of the air flow, and a downstream-side heat exchange part 28 provided so as to border on the downstream side of the air flow, these two parts being aligned in two rows. The upstream-side heat exchange part 27 extends so as to border on the upstream side of the air flow, and includes the plurality of flat multi-perforated tubes 21*b* arranged side by side in a vertical direction, and the heat transfer fins 21*a* secured to these flat multi-perforated tubes 21*b*. Similarly, the downstream-side heat exchange part 28 extends so as to border on the downstream side of the air flow, and includes the plurality of flat multi-perforated tubes 21*b* arranged side by side in a vertical direction, and the heat transfer fins 21*a* secured to these flat multi-perforated tubes 21*b*.

The heat exchange part 21, which has the upstream-side heat exchange part 27 and the downstream-side heat exchange part 28, is configured by a portion extending left to right along the back-surface side as seen in an overhead view, a portion extending front to back on one side of the blower chamber side, and a curved portion joining the two aforementioned portions. Such a curved portion is formed by bending the flat multi-perforated tubes 21*b*, but may be bent after the connecting header 23, the folding-back header 24, and the outlet/inlet header collecting tube 26 have all been connected to the flat multi-perforated tubes 21*b*, and may also be bent while these components are not connected, after which the operation of connecting these components is performed. The degree to which the outdoor heat exchanger 20 is curved in the curved portion is adjusted so that the portion extending left to right along the back-surface side and the portion extending front to back on one side of the blower chamber side are perpendicular to each other.

The diverter 22 is connected so as to link the liquid refrigerant pipeline 32 and the lower portion of the outlet/inlet header collecting tube 26. When, for example, the outdoor heat exchanger 20 functions as a refrigerant evaporator, the diverter 22 causes the refrigerant having flowed in from the liquid refrigerant pipeline 32 to be diverted in the height direction and guides the refrigerant to the lower portion of the outlet/inlet header collecting tube 26.

The outlet/inlet header collecting tube 26, which is a vertically extending tubular member, has an inlet-side portion and an outlet-side portion, which are vertically separated, for refrigerant entering and exiting the outdoor heat exchanger 20. The lower portion of the outlet/inlet header collecting tube 26 is connected to the liquid refrigerant pipeline 32 via the diverter 22 as described above. The upper portion of the outlet/inlet header collecting tube 26 is connected to the gas refrigerant pipeline 31. The outlet/inlet header collecting tube 26 is formed in a substantially cylindrical shape, the internal space of the upper portion and the internal space of the lower portion being vertically partitioned by a baffle (not shown) provided in the interior. The lower portion of the outlet/inlet header collecting tube 26 is vertically partitioned by a plurality of baffles so that the distribution of the refrigerant diverted by the diverter 22 is maintained. Specifically, a configuration is adopted such that each of the refrigerant flows set apart to the top and bottom by the diverter 22 are caused to flow to the heat exchange part 21 while remaining set apart.

Due to the above-described configuration, when the outdoor heat exchanger 20 functions as a refrigerant evaporator, the refrigerant, having evaporated after flowing into the heat exchange part 21 via the liquid refrigerant pipeline 32, the diverter 22, and the lower portion of the outlet/inlet header collecting tube 26, proceeds to flow out of the outdoor heat exchanger 20 via the upper portion of the outlet/inlet header collecting tube 26 and the gas refrigerant pipeline 31. In cases where the outdoor heat exchanger 20 functions as a heat radiator for the refrigerant, the refrigerant flows in the direction opposite that described above.

The connecting header 23 is provided on the side (the lower right side in FIG. 3) opposite of the end part of the side where the outlet/inlet header collecting tube 26 and the folding-back header 24 are provided within the outdoor heat exchanger 20 (the upper left side in FIG. 3), and is configured so as to either guide the refrigerant flowing through the flat multi-perforated tubes 21*b* of the upstream-side heat exchange part 27 to the flat multi-perforated tubes 21*b* of the downstream-side heat exchange part 28 at the same height position, or to guide the refrigerant flowing through the flat multi-perforated tubes 21*b* of the downstream-side heat exchange part 28 to the flat multi-perforated tubes 21*b* of the upstream-side heat exchange part 27 at the same height position. This connecting header 23 fulfills the role that flow paths of the refrigerant within the outdoor heat exchanger 20 are merely linked up at the same height position, without any vertical movement of the refrigerant being produced. On the front-surface side of the connecting header 23, front-side securing members 23*x* for securing the outdoor heat exchanger 20 to the blower chamber-side front panel 15 are provided separately in two locations, one upper and one lower.

The interior of the folding-back header 24 is vertically partitioned into a plurality of spaces. To the lower plurality of spaces among these are connected a lower plurality of flat multi-perforated tubes 21*b* within the downstream-side heat exchange part 28. To the upper plurality of spaces are connected an upper plurality of flat multi-perforated tubes 21*b* within the downstream-side heat exchange part 28.

The interconnecting part 25 is configured having a plurality of interconnecting pipelines, through which the upper plurality of spaces and the lower plurality of spaces, within the plurality of spaces vertically partitioned in the folding-back header 24, are connected in a one-to-one correspondence.

This configuration of the folding-back header 24 and the interconnecting part 25 makes it possible for the refrigerant that has flowed through the lower plurality of flat multi-perforated tubes 21*b* in the downstream-side heat exchange part 28 to flow out to the upper plurality of flat multi-perforated tubes 21*b* in the downstream-side heat exchange part 28 and to be turned back when, e.g., the outdoor heat exchanger 20 is functioning as a refrigerant evaporator.

(5) Heat Exchanger Assembly 29 and Installation Thereof

The outdoor heat exchanger 20 is sandwiched in the front-to-back direction (from the upstream side and downstream side with respect to the air flow direction) by a rear-side corrective member 60 and a front-side corrective member 70, described hereinafter, and is secured to the unit casing 10 and to a fixture on the unit casing 10. In this embodiment, the structure including the outdoor heat exchanger 20, the rear-side corrective member 60, and the front-side corrective member 70 is referred to as the heat exchanger assembly 29. The heat exchanger assembly 29 may include additional members, and in the present embodiment includes a rubber sheet 80, a forward insulative buffer member 87, a rearward insulative buffer member 86, and an upper insulative buffer member 88, which are described hereinafter.

The rear-side corrective member 60 and the front-side corrective member 70, as with the unit casing 10, are configured from the same type of metal or different types of metals other than aluminum and aluminum alloys, and in the present embodiment, an alloy configured with iron as the main component is used; thus, these members are configured from the same material as the unit casing 10. The rear-side corrective member 60 and the front-side corrective member 70 are both configured with a thickness of 1 to 2 mm inclusive, and the rear-side corrective member 60 may be configured to be thicker than the front-side corrective member 70.

Figure 7:
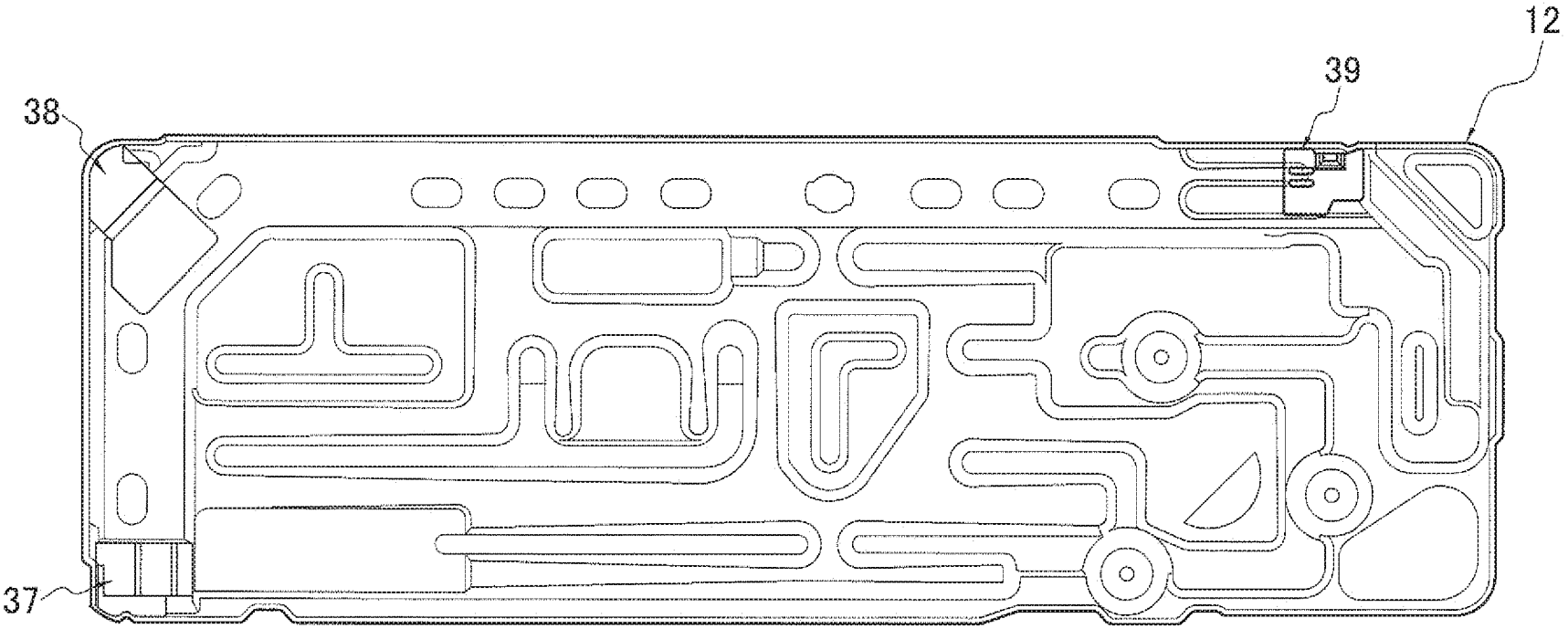
FIG. 7 is a schematic configuration diagram in plan view of the bottom frame with spacers disposed thereon.
Figure 8:
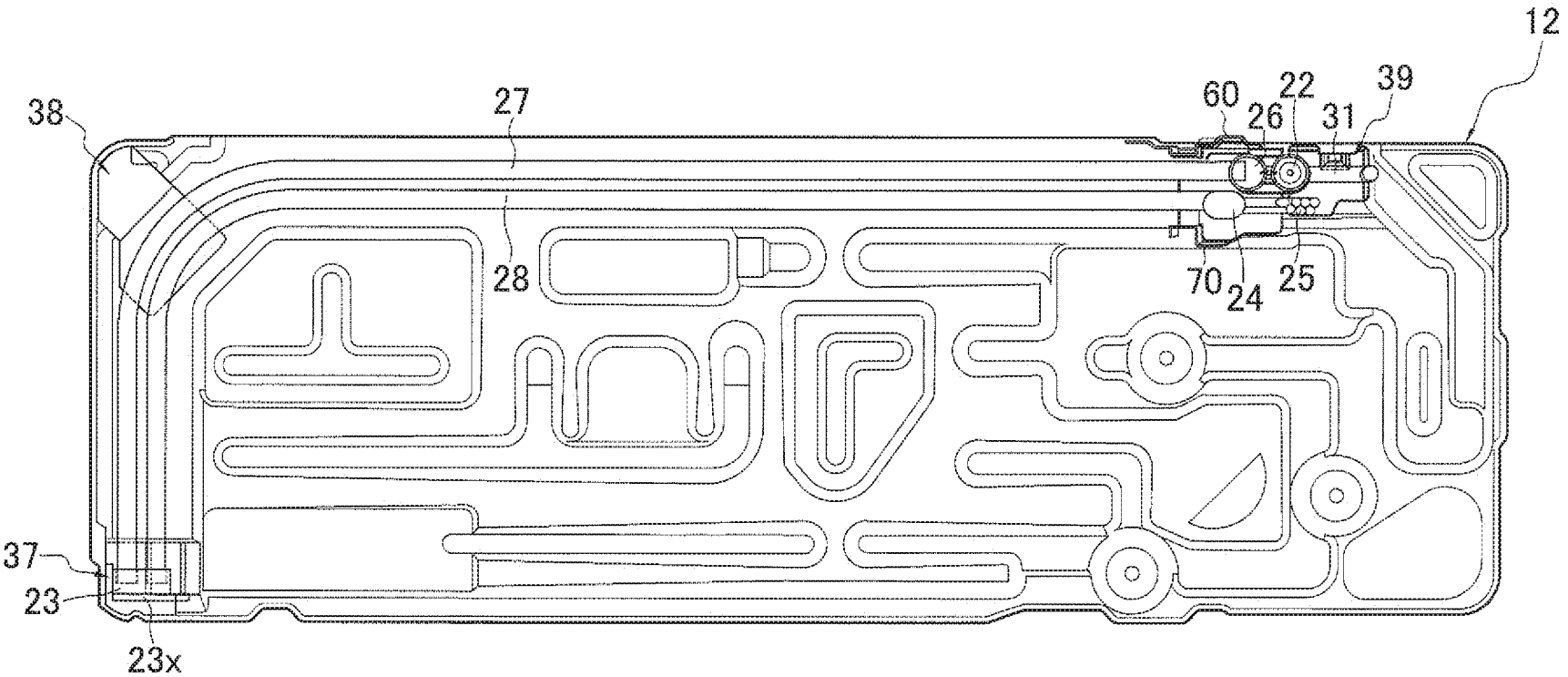
FIG. 8 is a schematic configuration diagram in overhead view of the bottom frame with the spacers disposed thereon and a heat exchanger assembly disposed on the spacers.

FIG. 6 shows a schematic configuration diagram in plan view of the bottom frame 12. FIG. 7 shows a schematic configuration diagram in plan view of the bottom frame 12 with spacers 37, 38, 39 disposed thereon. FIG. 8 shows a schematic configuration diagram in overhead view of the bottom frame 12 with spacers 37, 38, 39 disposed thereon and the heat exchanger assembly 29 disposed on the spacers.

The heat exchanger assembly 29 is disposed on the bottom frame 12 with the spacers 37, 38, 39 therebetween, as shown in these drawings. The spacers 37, 38, 39 include a front-side spacer 37 disposed between the bottom frame 12 and the lower part of the connecting header 23 at the forward end of the outdoor heat exchanger 20, a corner spacer 38 disposed between the bottom frame 12 and the lower part of the curved portion of the outdoor heat exchanger 20, and a rear-side spacer 39 disposed between the bottom frame 12 and the lower part of the diverter 22. These spacers 37, 38, 39 are all positioned by being disposed so that the side surfaces thereof are in contact with the side-wall portion 12*b* of the bottom frame 12. Additionally, these spacers 37, 38, 39 are all configured by insulative and elastic members, and in the present embodiment are configured by rubber (specifically, chloroprene rubber).

Figure 9:
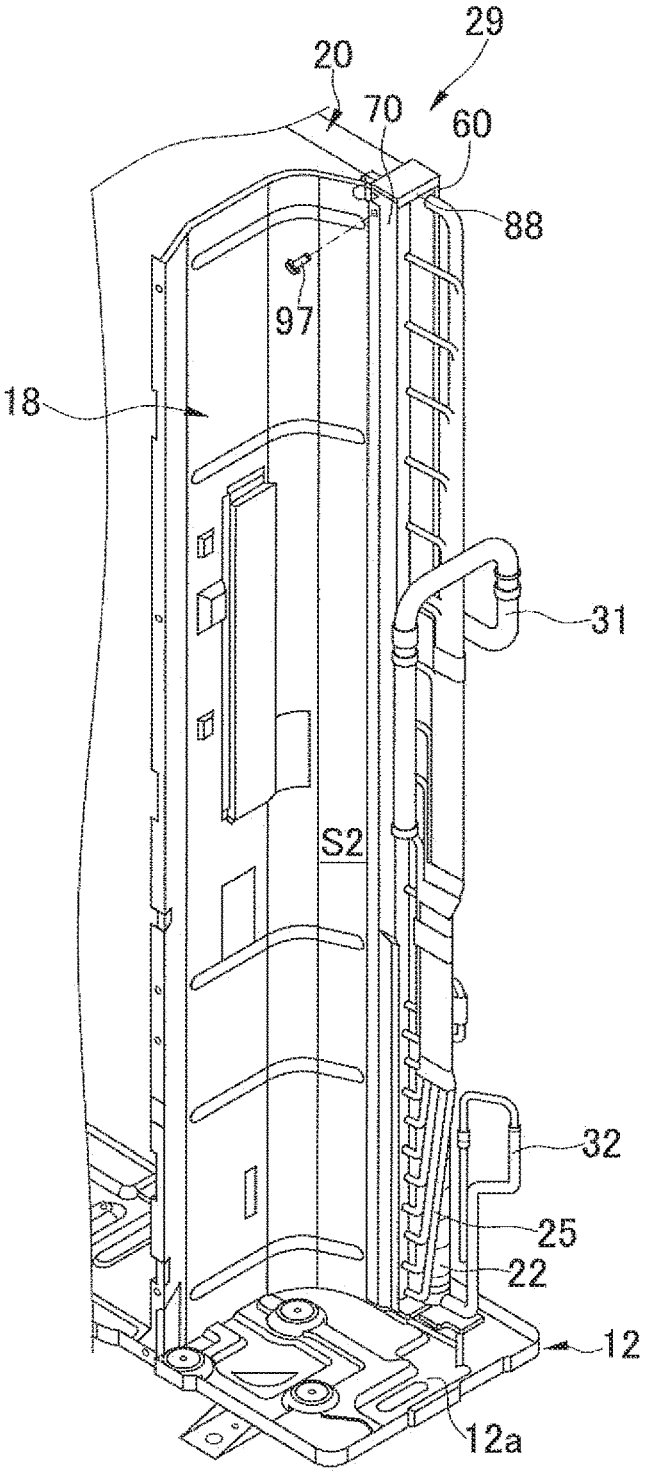
FIG. 9 is a schematic perspective view showing the arrangement of a front-side corrective member as seen from the front side.
Figure 10:
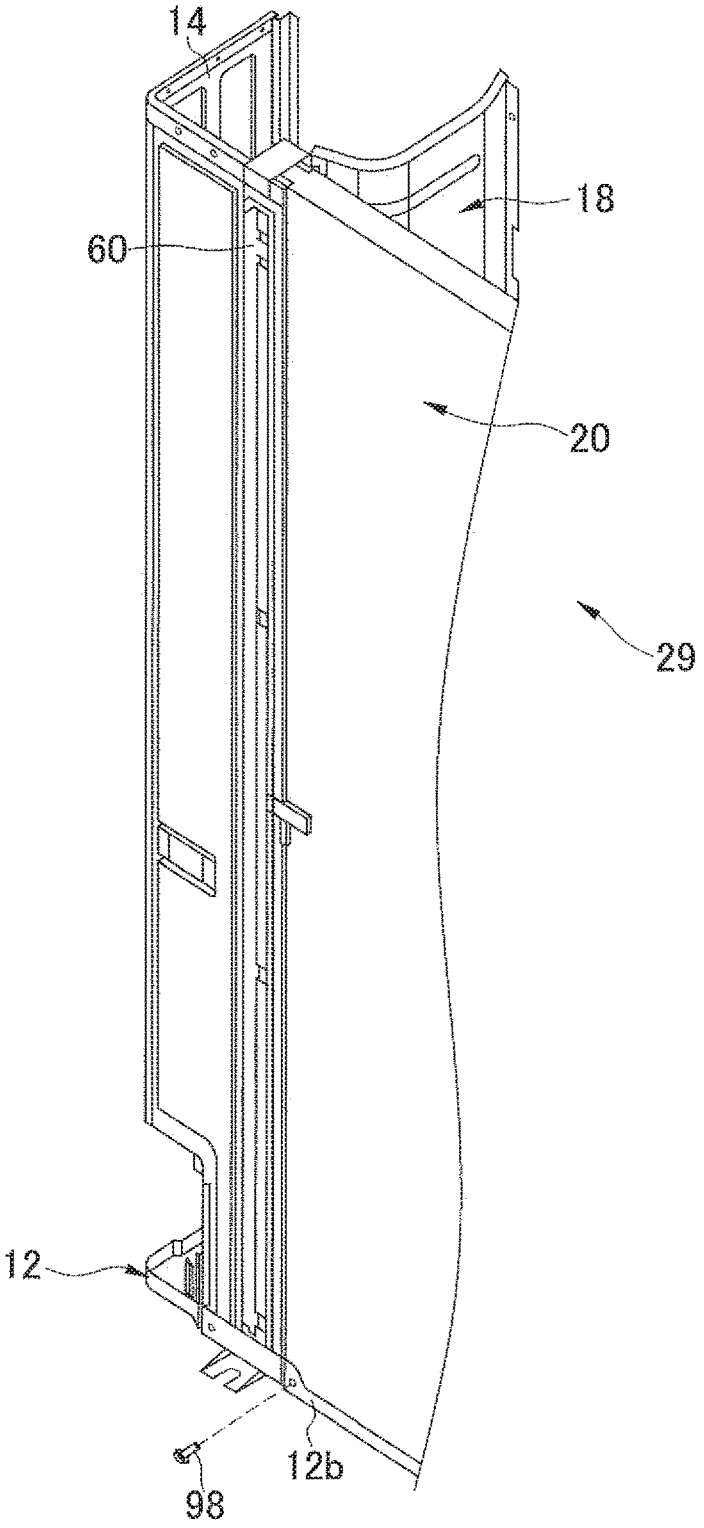
FIG. 10 is a schematic perspective view showing the arrangement of a rear-side corrective member as seen from the rear side.
Figure 11:
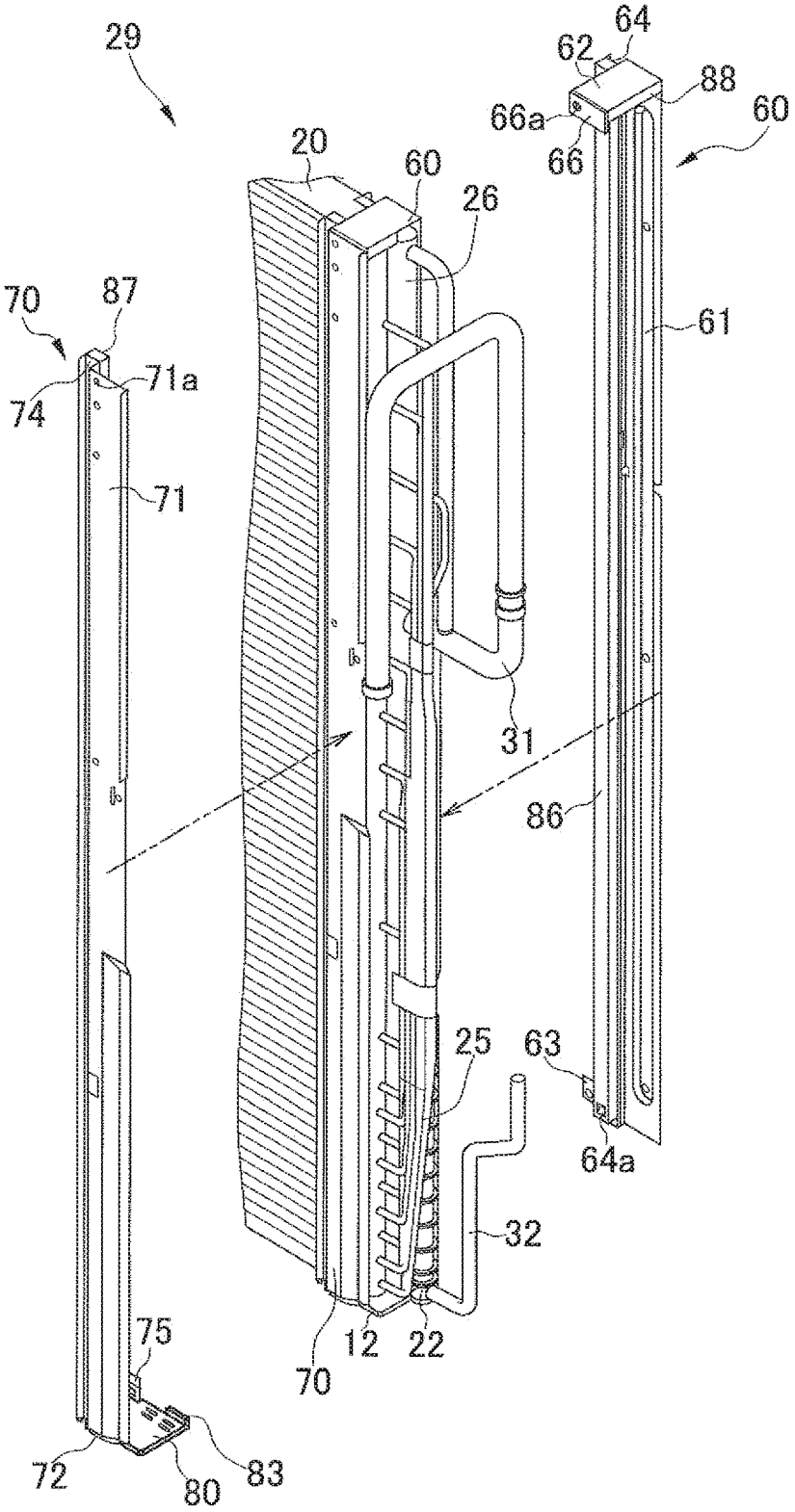
FIG. 11 is a schematic perspective view showing the manner in which the outdoor heat exchanger is sandwiched by the front-side corrective member and the rear-side corrective member.
Figure 12:
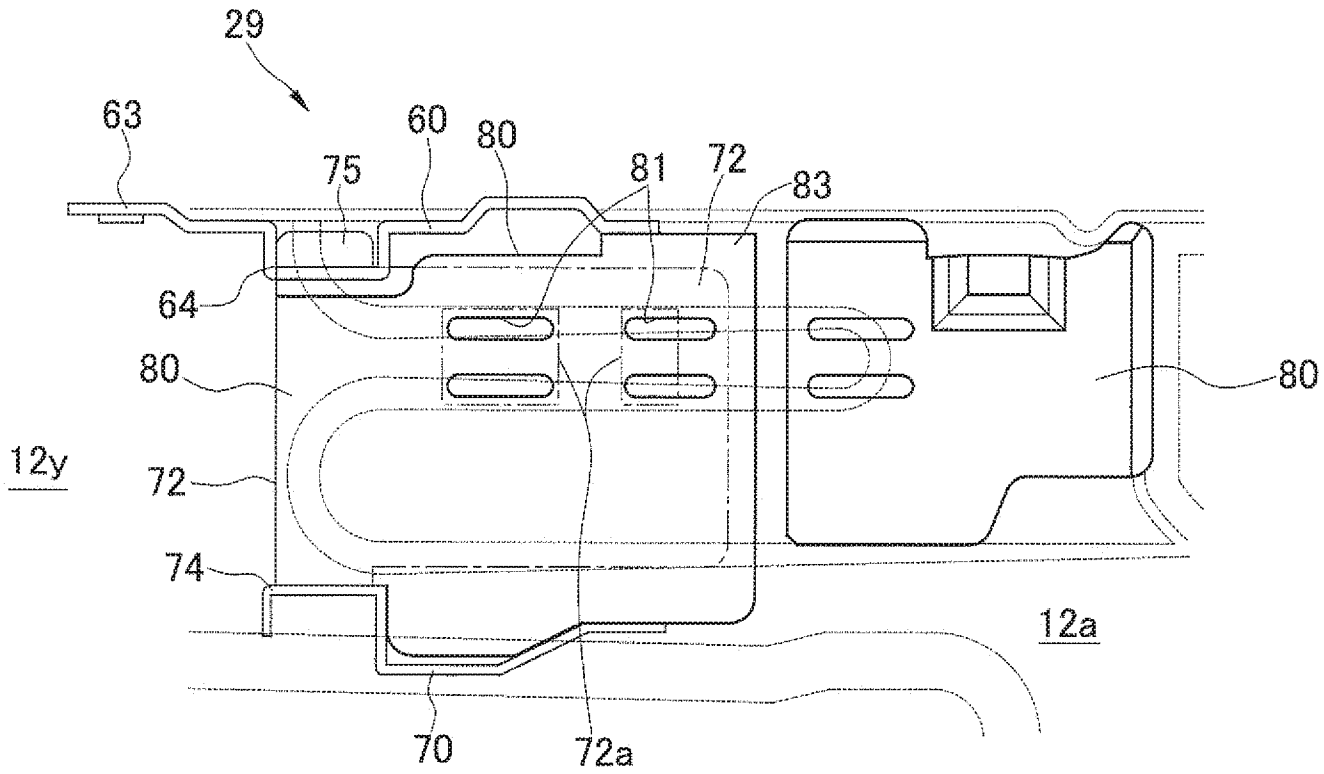
FIG. 12 is a schematic overhead view showing the arrangement of the front-side corrective member and the rubber sheet with respect to the bottom frame.
Figure 13:
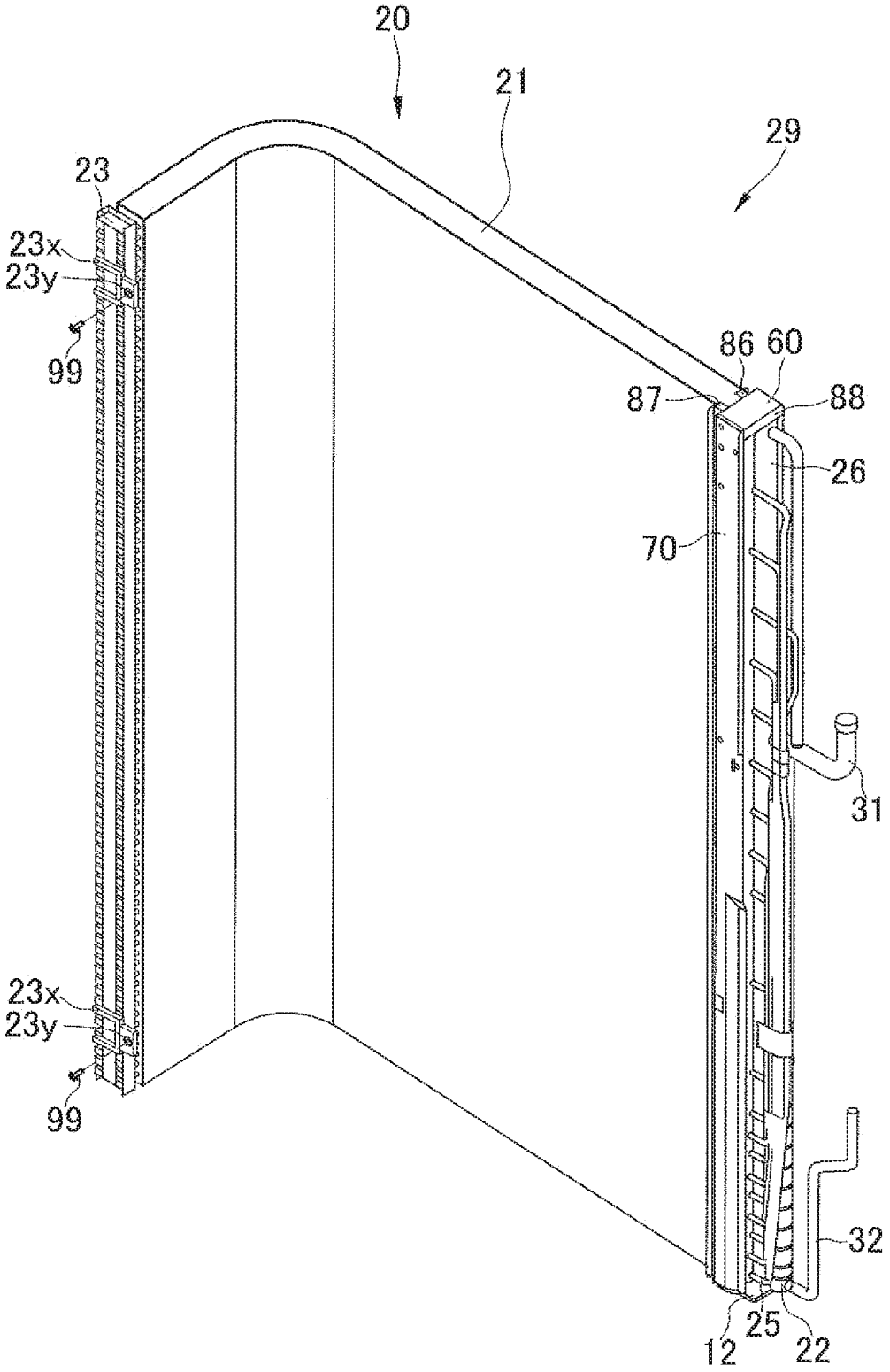
FIG. 13 is a schematic perspective view of the front-surface side of the heat exchanger assembly.
Figure 14:
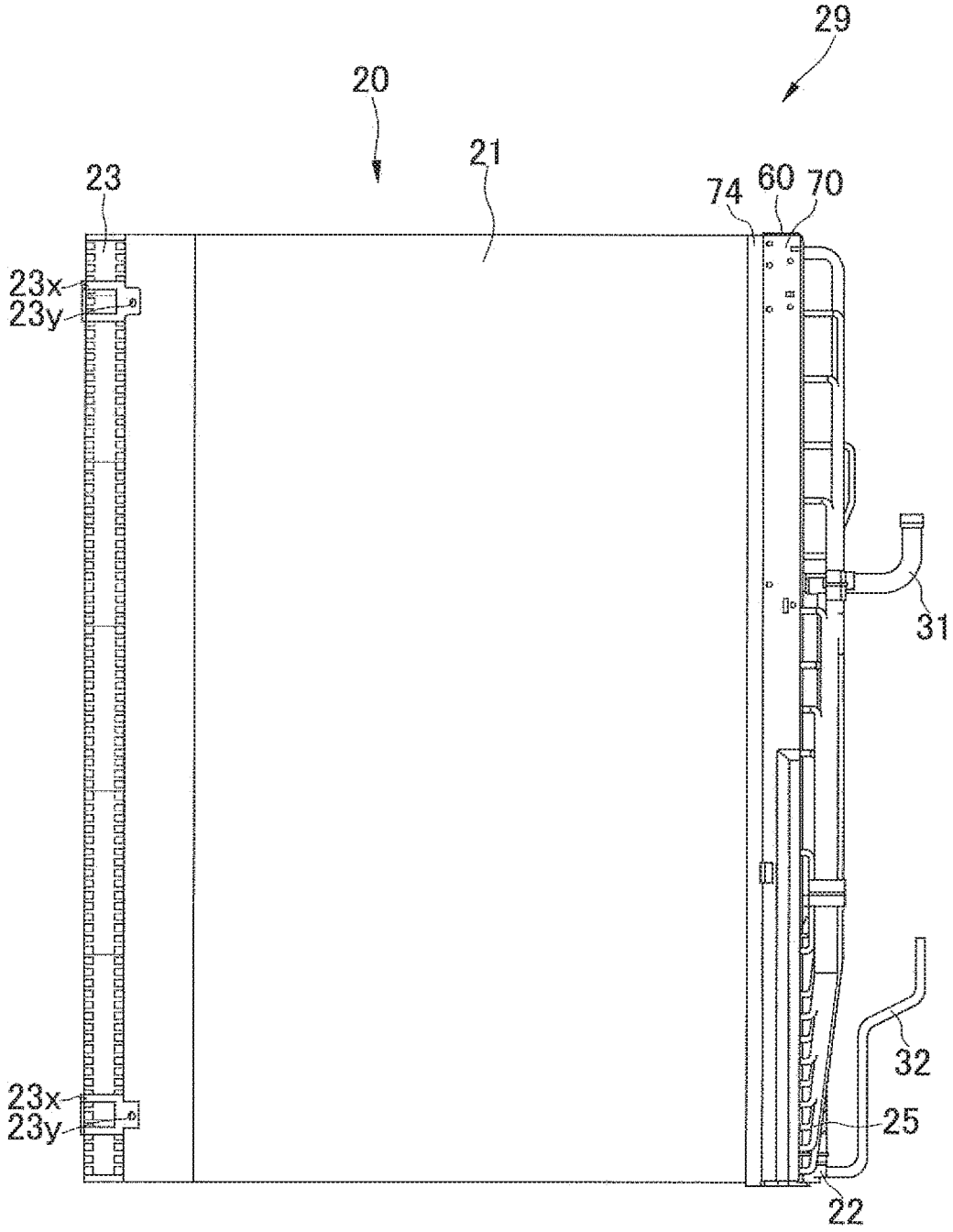
FIG. 14 is a front surface view of the heat exchanger assembly.
Figure 15:
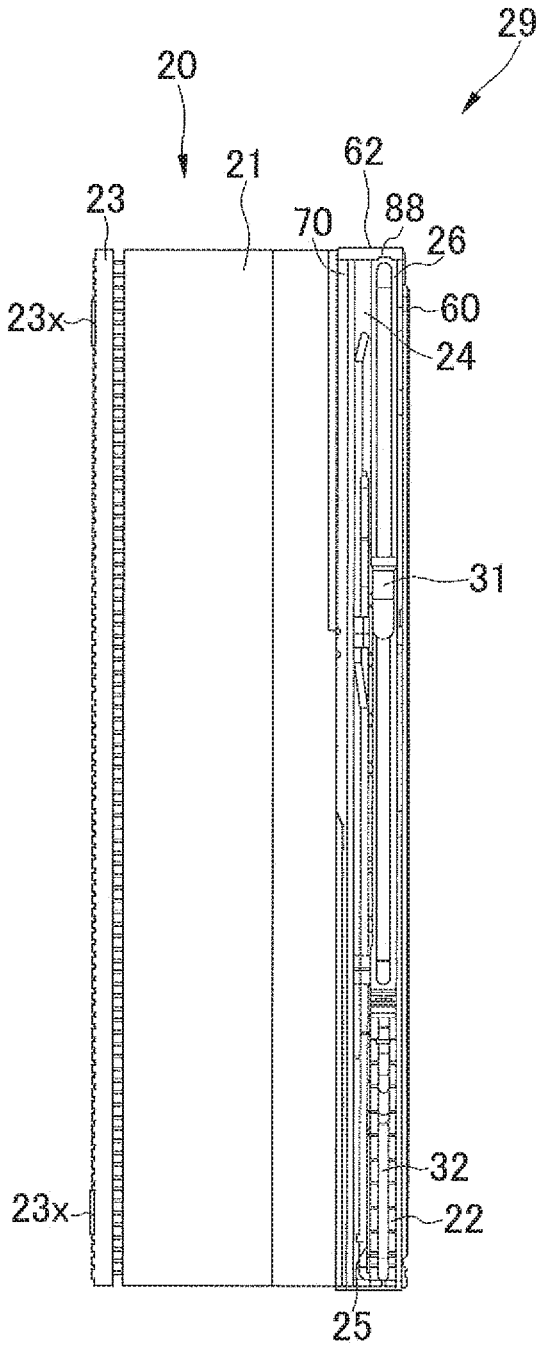
FIG. 15 is a right-side surface view of the heat exchanger assembly.
Figure 16:
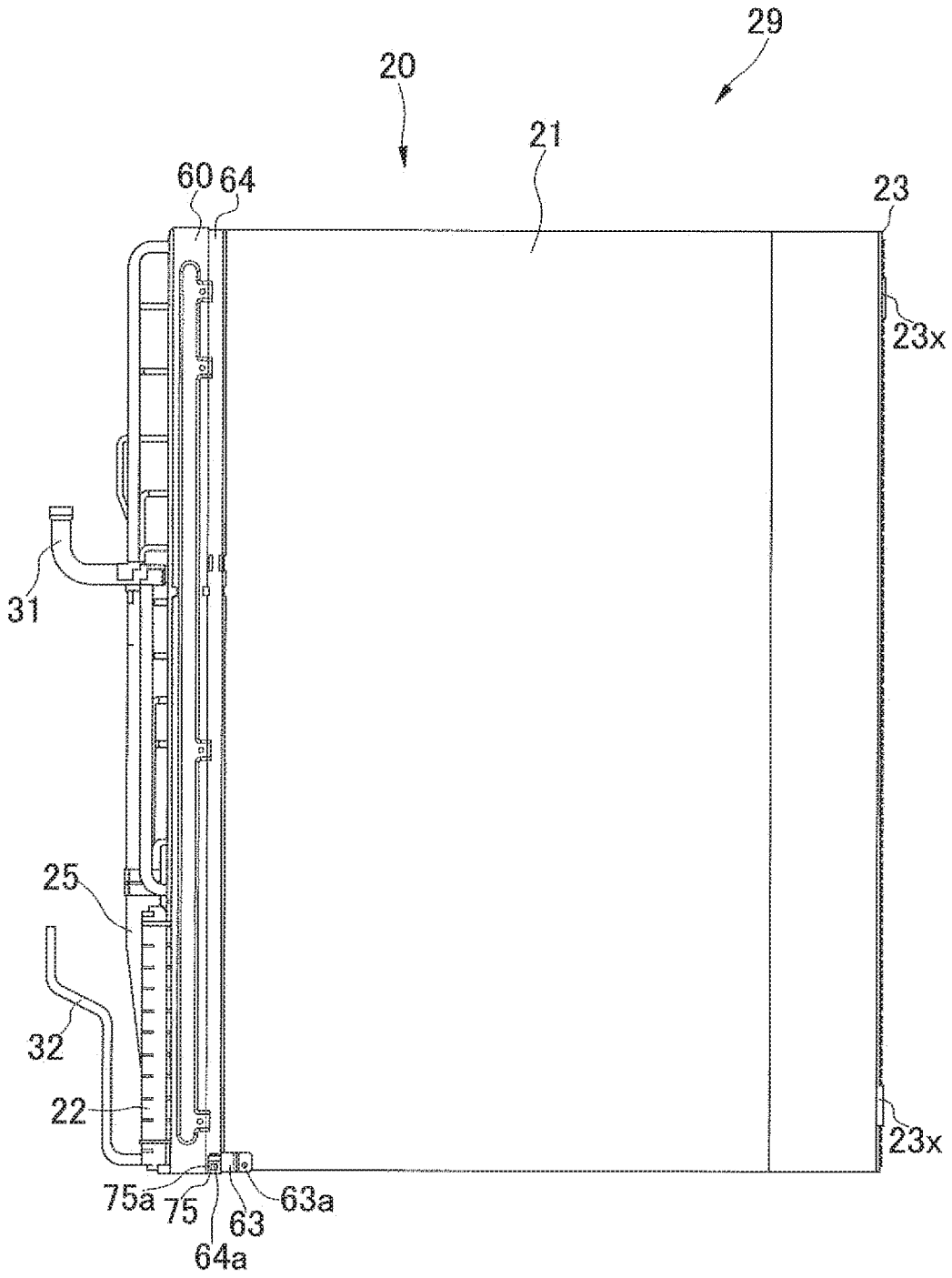
FIG. 16 is a back surface view of the heat exchanger assembly.
Figure 17:
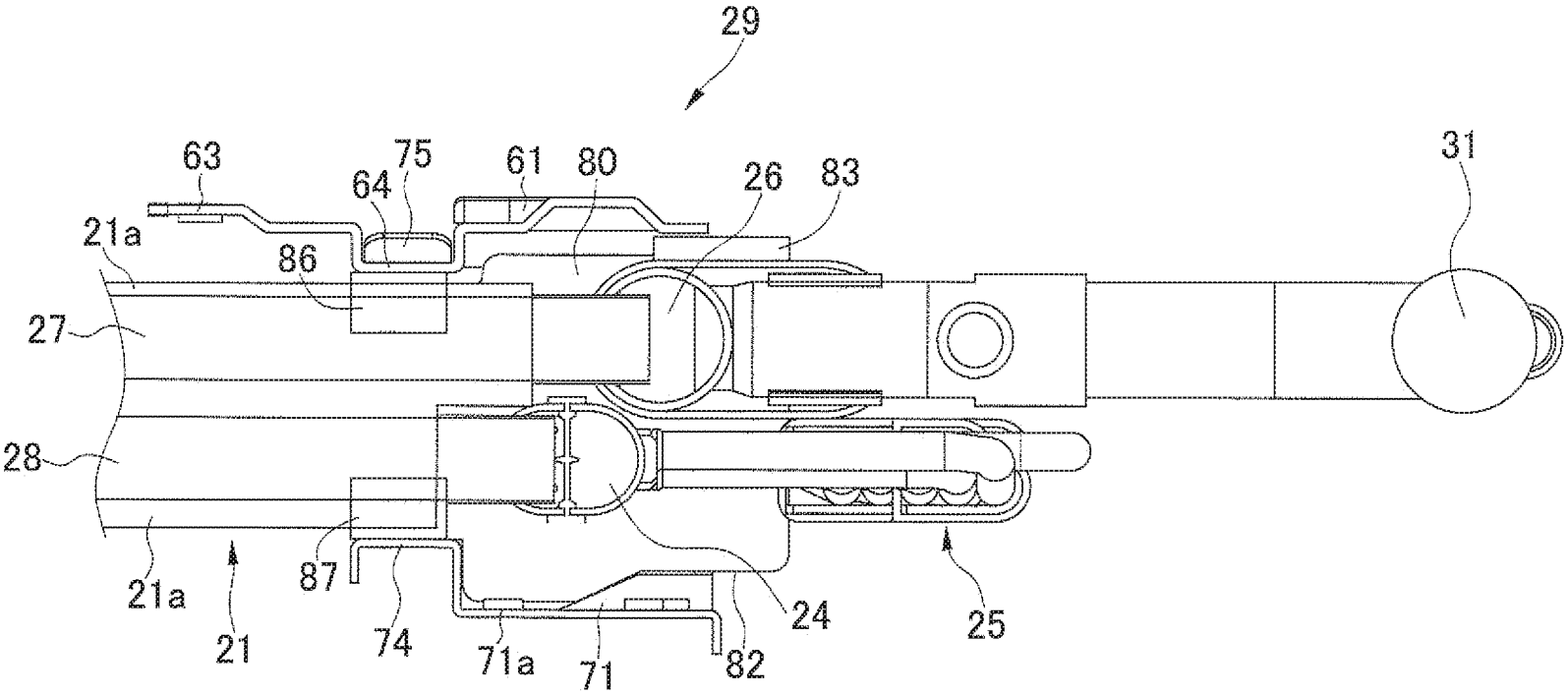
FIG. 17 is an overhead schematic configuration diagram of the vicinity of the front-side corrective member and the rear-side corrective member of the heat exchanger assembly.

In the schematic perspective view of FIG. 9, the arrangement of the front-side corrective member 70 as seen from the front side is shown. In the schematic perspective view of FIG. 10, the arrangement of the rear-side corrective member 60 as seen from the rear side is shown. The schematic perspective view of FIG. 11 shows the manner in which the outdoor heat exchanger 20 is sandwiched by the front-side corrective member 70 and the rear-side corrective member 60 (FIG. 11 shows the front-side corrective member 70 and the rear-side corrective member 60 before being combined). The schematic overhead view of FIG. 12 shows the arrangement of the front-side corrective member 70 and the rubber sheet 80 with respect to the bottom frame 12 (in FIG. 12, the bottom frame 12 is shown with dotted lines, and the reverse side of the rubber sheet 80 of the front-side corrective member 70 is shown with dotdash lines). FIG. 13 is a schematic perspective view of the front-surface side of the heat exchanger assembly 29. FIG. 14 is a front surface view of the heat exchanger assembly 29. FIG. 15 is a right-side surface view of the heat exchanger assembly 29. FIG. 16 is a back surface view of the heat exchanger assembly 29. FIG. 17 is an overhead schematic configuration diagram of the vicinity of the front-side corrective member 70 and the rear-side corrective member 60 of the heat exchanger assembly 29.

The partition panel 18 partitioning the internal space of the unit casing 10 is secured to the bottom frame 12 by screws (not shown). The partition panel 18 is configured having a panel thickness of 0.6 mm. On the front side of the machinery chamber-side end part, the heat exchanger assembly 29 is secured due to the front-side corrective member 70 being fastened to the partition panel 18 by a screw 97, as shown in FIG. 9. On the rear side of the machinery chamber-side end part, the heat exchanger assembly 29 is secured due to the rear-side corrective member 60 being fastened to the side-wall portion 12*b* of the bottom frame 12 by a screw 98, as shown in FIG. 10. Furthermore, on the front-side end of the blower chamber side, the heat exchanger assembly 29 is secured by being fastened by screws 99 to the blower chamber-side front panel 15 of the unit casing 10, via the front-side securing members 23*x* attached to the front-surface side of the connecting header 23, as shown in FIGS. 13 and 14. Specifically, the upper and lower front-side securing members 23*x* of the connecting header 23 are provided with respective fastening openings 23*y* as shown in FIG. 13, the blower chamber-side front panel 15 of the unit casing 10 is provided with fastening openings 15*x* in two upper and lower locations as shown in FIG. 2, and with these fastening openings 23*y* and fastening openings 15*x* lined up, the heat exchanger assembly is securely fastened by the screws 99. The blower chamber-side front panel 15 of the unit casing 10 is securely fastened to the side-wall portion 12*b* of the bottom frame 12 (not shown). In this manner, the heat exchanger assembly 29 is fastened to the unit casing 10.

In the outdoor heat exchanger 20, the folding-back header 24, the outlet/inlet header collecting tube 26, and the flat multi-perforated tubes 21*b* and heat transfer fins 21*a* in proximity thereto are sandwiched in the front-to-back direction by the front-side corrective member 70 and the rear-side corrective member 60, as shown in FIGS. 11, 12, 15, and 17. A front-side main body part 71 of the front-side corrective member 70, which is positioned on the front-surface side of the outdoor heat exchanger 20, covers the folding-back header 24, the outlet/inlet header collecting tube 26, and the flat multi-perforated tubes 21*b* and heat transfer fins 21*a* in proximity thereto from the front side, as shown in FIG. 14. The front-side corrective member 70 also has a front-side convex part 74, which extends to the left from the front-side main body part 71 and which is formed protruding rearward, as shown in FIGS. 12 and 17. The front-side convex part 74 extends vertically from the upper end of the front-side corrective member 70 to the lower end. The forward insulative buffer member 87 is adhered to the entire rear side of the front-side convex part 74. The forward insulative buffer member 87, when installed, comes to be crushed by the front-side convex part 74 of the front-side corrective member 70 and the heat transfer fins 21*a* of the outdoor heat exchanger 20, the front-side end part being pushed rearward by the front-side convex part 74 of the front-side corrective member 70, and the rear-side end part being pushed forward by the front-end portions of the heat transfer fins 21*a* of the outdoor heat exchanger 20. A rear-side main body part 61 of the rear-side corrective member 60, which is positioned on the rear-surface side of the outdoor heat exchanger 20, covers the folding-back header 24, the outlet/inlet header collecting tube 26, and the flat multi-perforated tubes 21*b* and heat transfer fins 21*a* in proximity thereto from the rear side, as shown in FIG. 16. The rear-side corrective member 60 also has a rear-side convex part 64 which extends to the left from the rear-side main body part 61 and which is formed protruding forward, as shown in FIGS. 12 and 17. The rear-side convex part 64 extends vertically from the upper end of the rear-side corrective member 60 to the lower end. The rearward insulative buffer member 86 is adhered to the entire front side of the rear-side convex part 64. The rearward insulative buffer member 86, when installed, comes to be crushed by the rear-side convex part 64 of the rear-side corrective member 60 and the heat transfer fins 21*a* of the outdoor heat exchanger 20, the rear-side end part being pushed forward by the rear-side convex part 64 of the rear-side corrective member 60, and the front-side end part being pushed rearward by the rear-end portions of the heat transfer fins 21*a* of the outdoor heat exchanger 20.

Additionally, in the outdoor heat exchanger 20, the folding-back header 24, the outlet/inlet header collecting tube 26, and the flat multi-perforated tubes 21*b* and heat transfer fins 21*a* in proximity thereto are sandwiched in the vertical direction by the front-side corrective member 70 and the rear-side corrective member 60, as shown in FIGS. 11, 12, 13, and 15. A front-side bottom part 72 of the front-side corrective member 70, which is positioned below the outdoor heat exchanger 20, covers the folding-back header 24, the outlet/inlet header collecting tube 26, and the flat multi-perforated tubes 21*b* and heat transfer fins 21*a* in proximity thereto from below, as shown in FIGS. 11 and 12. The rubber sheet 80 is placed on the upper surface of the front-side bottom part 72 of the front-side corrective member 70, as shown in FIGS. 11 and 12. The folding-back header 24 and the outlet/inlet header collecting tube 26 are positioned on the rubber sheet 80, which in the installed state bears the gravitational force of the folding-back header 24 and the outlet/inlet header collecting tube 26. A rear-side top surface part 62 of the rear-side corrective member 60, which is positioned above the outdoor heat exchanger 20, covers the folding-back header 24, the outlet/inlet header collecting tube 26, and the flat multi-perforated tubes 21*b* and heat transfer fins 21*a* in proximity thereto from above, as shown in FIG. 11. The upper insulative buffer member 88 is adhered to the lower-surface side of the rear-side top surface part 62 of the rear-side corrective member 60, as shown in FIGS. 9, 11, 13, and 15. The upper insulative buffer member 88, when installed, comes to be crushed from above and below by the rear-side top surface part 62 of the rear-side corrective member 60 and the folding-back header 24 and outlet/inlet header collecting tube 26 of the outdoor heat exchanger 20, the upper-side end part being pushed downward by the rear-side top surface part 62 of the rear-side corrective member 60, and the lower-side end part being pushed upward by the upper-end portions of the folding-back header 24 and/or the outlet/inlet header collecting tube 26 of the outdoor heat exchanger 20.

In this apparatus, the rubber sheet 80, similar to the front-side spacer 37, the corner spacer 38, and the rear-side spacer 39, is configured from an elastic and insulative rubber (in the present embodiment, chloroprene rubber).

The forward insulative buffer member 87, the rearward insulative buffer member 86, and the upper insulative buffer member 88 are all configured by an elastic and insulative rubber (in the present embodiment, ethylene propylene diene rubber (EPDM)). In the present embodiment, the rubber sheet 80 is configured by a different material than the forward insulative buffer member 87, the rearward insulative buffer member 86, and the upper insulative buffer member 88, but may be configured by the same material. The forward insulative buffer member 87 and the rearward insulative buffer member 86, when not installed, have a predetermined thickness in the front-to-back direction, and, when installed, have a thickness of approximately two to four tenths of the original thickness. The forward insulative buffer member 87, the rearward insulative buffer member 86, the upper insulative buffer member 88, and the rubber sheet 80 are capable of suppressing air flow that does not pass through the outdoor heat exchanger 20.

Thus, the outdoor heat exchanger 20, the front-side corrective member 70, and the rear-side corrective member 60 are not in direct contact with each other and are not fastened by screws or the like, but are sandwiched and secured by frictional force with the interposed rubber sheet 80, forward insulative buffer member 87, rearward insulative buffer member 86, and upper insulative buffer member 88.

Figure 18:
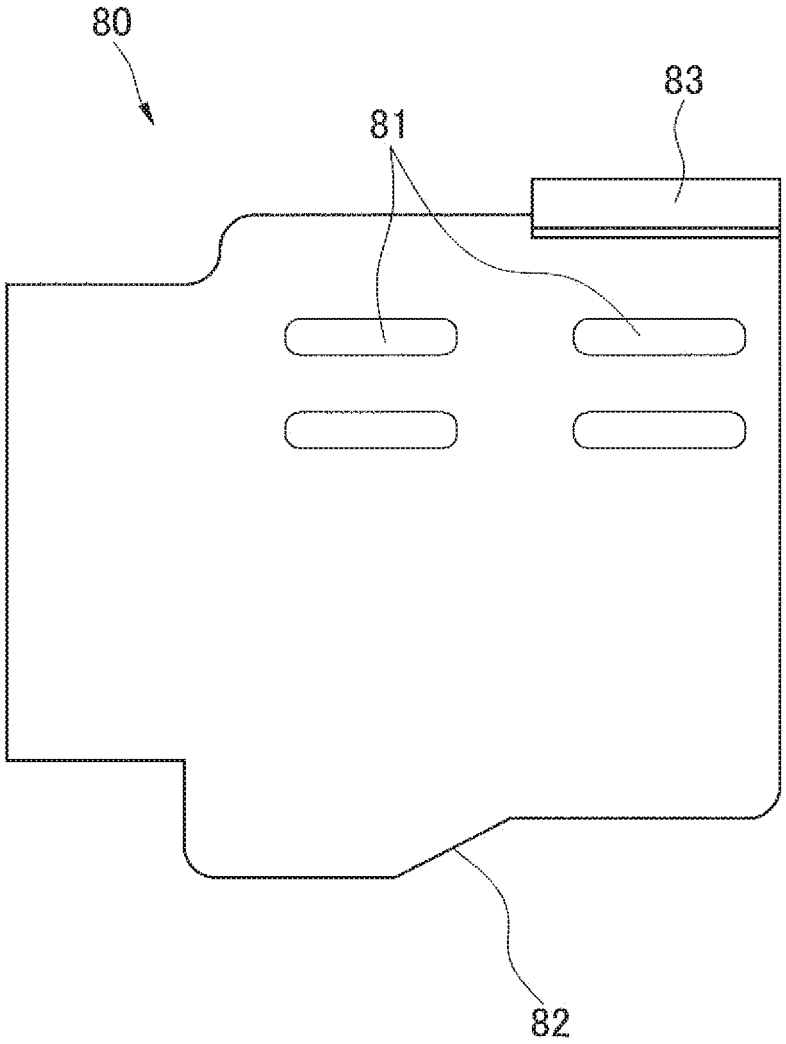
FIG. 18 is a schematic configuration drawing in overhead view of the rubber sheet.
Figure 19:
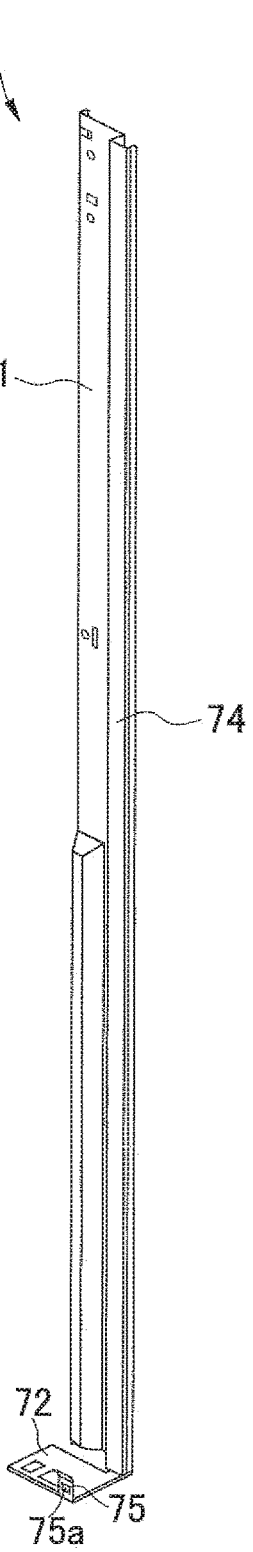
FIG. 19 is a schematic perspective view of the back-surface side of the front-side corrective member.
Figure 20:
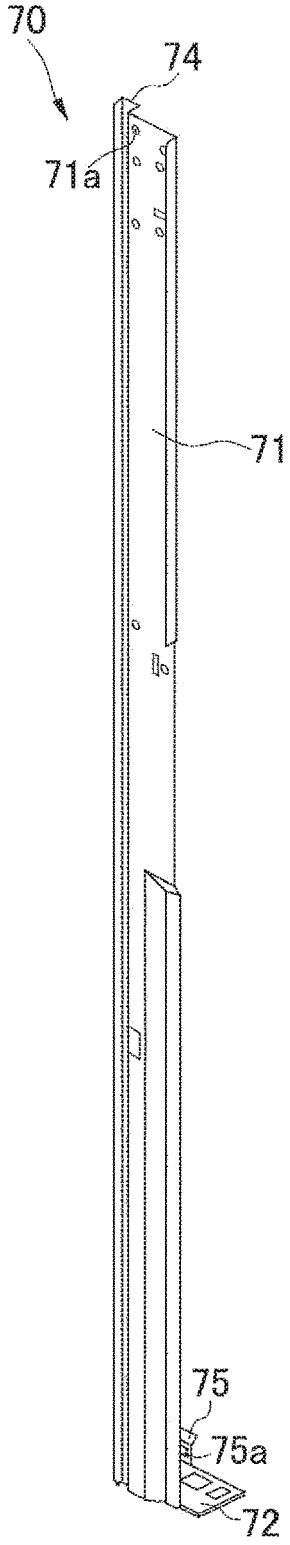
FIG. 20 is a schematic perspective view of the front-surface side of the front-side corrective member.
Figure 21:
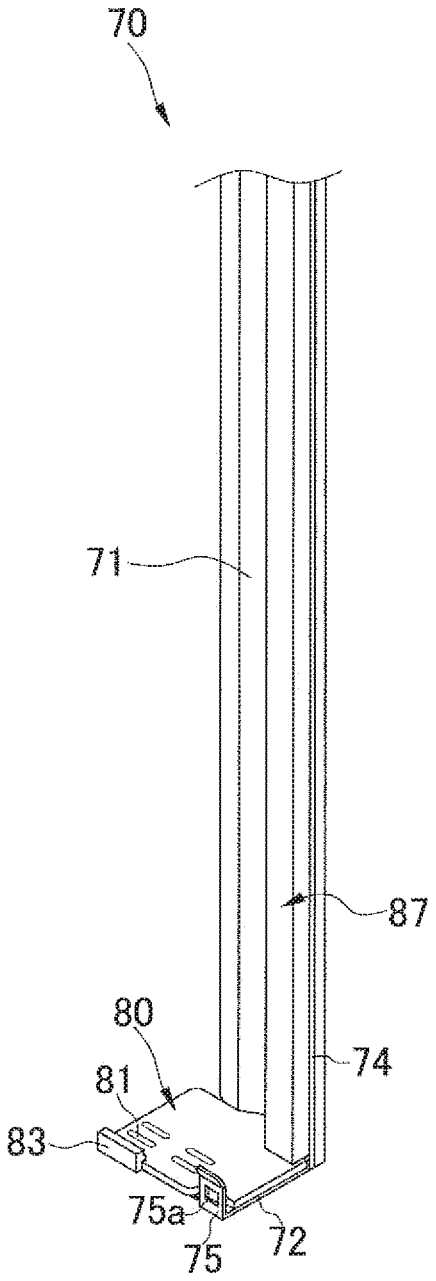
FIG. 21 is a schematic perspective view of the back-surface side of the front-side corrective member with the rubber sheet attached thereto.

FIG. 18 is a schematic configuration drawing in overhead view of the rubber sheet 80. FIG. 19 is a schematic perspective view of the back-surface side of the front-side corrective member 70. FIG. 20 is a schematic perspective view of the front-surface side of the front-side corrective member 70. FIG. 21 is a schematic perspective view of the back-surface side of the front-side corrective member 70 with the rubber sheet 80 attached thereto.

The rubber sheet 80 is adhered via an adhesive to the upper surface of the front-side bottom part 72 of the front-side corrective member 70, as described above. The rubber sheet 80 has water-draining openings 81, which are four through-holes formed so as to extend left-to-right in the right rear part of the rubber sheet. Additionally, the front-side bottom part 72 of the front-side corrective member 70 has formed therein bottom-part openings 72*a*, which pass through in the vertical direction, i.e., the panel thickness direction, in two locations in the right rear part of the front-side bottom part, as shown in FIGS. 12, 19, and 20. The water-draining openings 81 of the rubber sheet 80 and the bottom-part openings 72*a* provided in the front-side bottom part 72 of the front-side corrective member 70 are positioned so as to be aligned in the vertical direction when the rubber sheet 80 has been attached to the front-side bottom part 72. Condensation water produced in the folding-back header 24 and/or the outlet/inlet header collecting tube 26 thereby passes through the water-draining openings 81 and the bottom-part openings 72*a* and flows over a water-draining surface 12*y* of the bottom frame 12 to be drained from a water-draining port 12*x*. A front-side edge 82 of the rubber sheet 80 has a shape that bulges to the front-surface side, and is formed so as to conform to the shape of the lower end of the front-side main body part 71 of the front-side corrective member 70. A support part 83 standing vertically upright is formed in the right rear-side end part of the rubber sheet 80. The support part 83 of the rubber sheet 80 is capable of supporting the lower-end vicinity of the rear-side main body part 61 of the rear-side corrective member 60 from the front side, as shown in FIGS. 12 and 17.

The front-side main body part 71 of the front-side corrective member 70, which has a surface widening in the vertical and left-to-right directions, is provided so as to be vertically longer than the folding-back header 24 and the outlet/inlet header collecting tube 26, as shown in FIGS. 20 and 21. The left-to-right width of the front-side main body part 71 is configured so as to be approximately between 1.5 times and 3 times, inclusive, the left-to-right width of the outlet/inlet header collecting tube 26, which makes it possible to suppress the degree of resistance to air passing through the outdoor heat exchanger 20 while ensuring the strength for sandwiching the outdoor heat exchanger 20. The upper-left end vicinity of the front-side main body part 71 is provided with a screw hole 71*a*, which passes through in the front-to-back direction, for fastening the front-side main body part using a screw hole 66*a* provided to a hereinafter-described rear-side front surface part 66 of the rear-side corrective member 60, and a screw hole (not shown) provided to the upper end vicinity of the partition panel 18. Additionally, a securing wall 75 standing upward from the left rear-side end part is formed in the front-side bottom part 72 of the front-side corrective member 70, as shown in FIGS. 19, 20, and 21. A securing opening 75*a* that opens in the front-to-back direction is formed in the middle vicinity of the securing wall 75.

In an overhead view, the front-side convex part 74 of the front-side corrective member 70 extends rearward from the left-side end part of the front-side main body part 71, then bends to extend to the left, and bends again to extend to the front, as shown in FIGS. 12 and 17. In this manner, the front-side convex part 74 forms a shape that protrudes rearward from the front side in an overhead view. The forward insulative buffer member 87 is adhered to a portion above the rubber sheet 80 on the rear side of the front-side convex part 74, as shown in FIG. 21.

Figure 22:
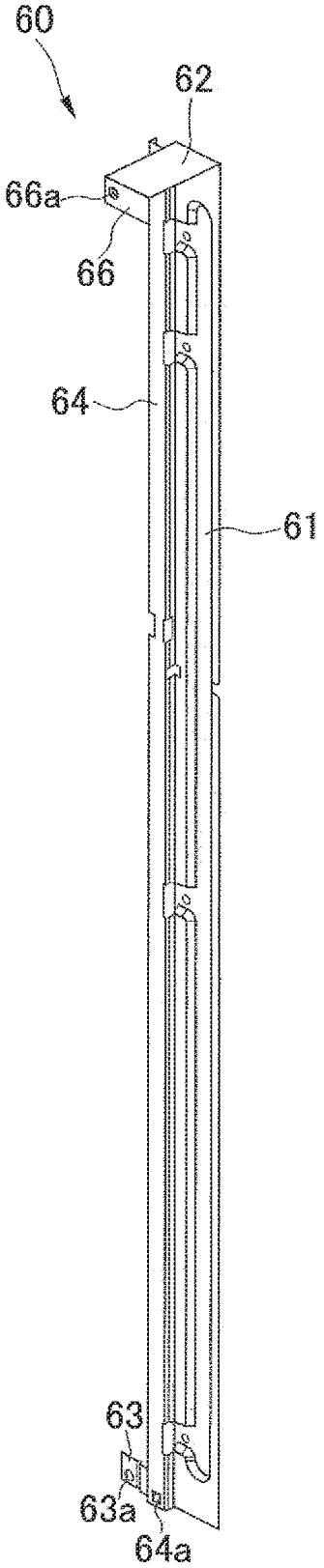
FIG. 22 is a schematic perspective view of the front-surface side of the rear-side corrective member.
Figure 23:
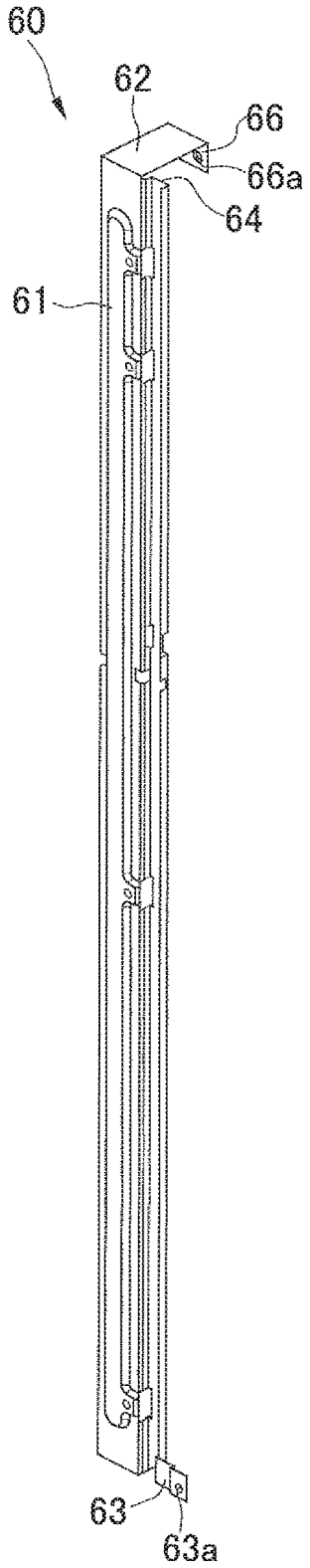
FIG. 23 is a schematic perspective view of the back-surface side of the rear-side corrective member.

FIG. 22 is a schematic perspective view of the front-surface side of the rear-side corrective member 60. FIG. 23 is a schematic perspective view of the back-surface side of the rear-side corrective member 60.

The rear-side main body part 61 of the rear-side corrective member 60, which has a surface widening in the vertical and left-to-right directions, is provided so as to be vertically longer than the folding-back header 24 and the outlet/inlet header collecting tube 26, as shown in FIGS. 22 and 23. The left-to-right width of the rear-side main body part 61, while somewhat less than the left-to-right width of the front-side main body part 71, is configured so as to be approximately between 1.5 times and 3 times, inclusive, the left-to-right width of the outlet/inlet header collecting tube 26, which makes it possible to suppress the degree of resistance to air passing through the outdoor heat exchanger 20 while ensuring the strength for sandwiching the outdoor heat exchanger 20. The rear-side corrective member 60 has the rear-side front surface part 66, which juts out downward from the front-side end part of the rear-side top surface part 62. The screw hole 66*a*, which passes through in the front-to-back direction, is formed in the upper right of the rear-side front surface part 66. The screw hole 66*a* of the rear-side front surface part 66 is, as described above, lined up with the screw hole 71*a* of the front-side main body part 71 and the screw hole (not shown) provided in the upper end vicinity of the partition panel 18, and the rear-side front surface part is securely fastened by the screw 97. In an overhead view, the rear-side convex part 64 of the rear-side corrective member 60 extends forward from the left-side end part of the rear-side main body part 61, then bends to extend to the left, and bends again to extend to the rear, as shown in FIGS. 12 and 17. In this manner, the rear-side convex part 64 forms a shape that protrudes forward from the rear side in an overhead view. The rearward insulative buffer member 86 is adhered to a higher portion than the rubber sheet 80 on the front side of the rear-side convex part 64. An interlocking pawl 64*a*, made to protrude rearward, is formed in the lower-end vicinity of the rear-side convex part 64. The interlocking pawl 64*a* of the rear-side corrective member 60 is inserted into the previously-described securing opening 75*a* in the securing wall 75 of the front-side corrective member 70, in which state the front-side corrective member 70 can be hooked and secured to the rear-side corrective member 60. A rear-side securing part 63, jutting further out to the left, is formed in the lower end of the left-side end part of the rear-side convex part 64 of the rear-side corrective member 60. A screw hole 63*a*, which passes through in the front-to-back direction, is formed in the center vicinity of the rear-side securing part 63. This screw hole 63*a* is lined up with a screw hole (not shown) provided in the right rear side of the side-wall portion 12*b* of the bottom frame 12, and the rear-side securing part is secured by the screw 98.

Figure 24:
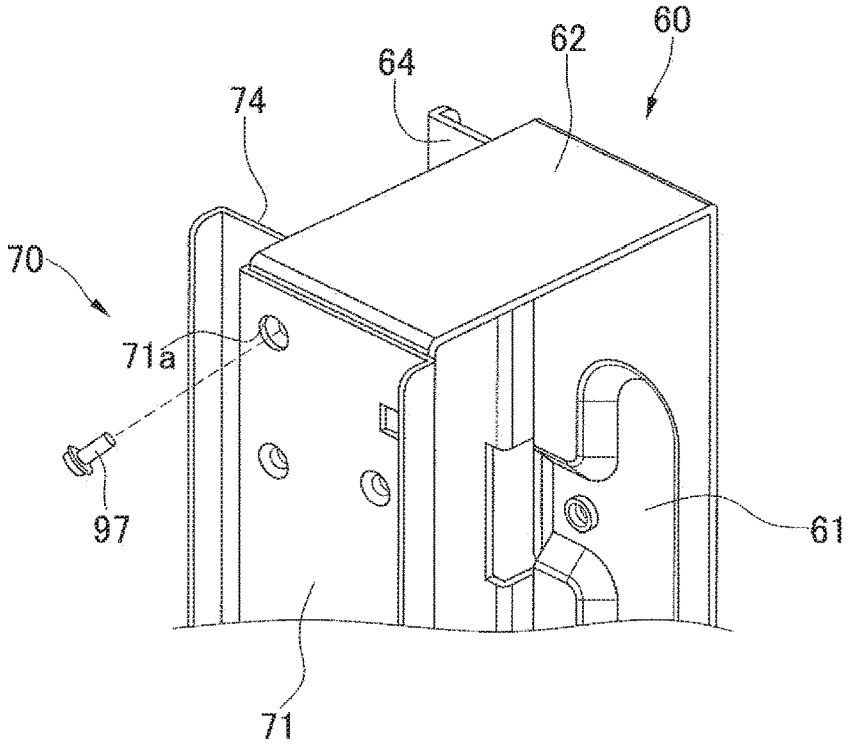
FIG. 24 is a front-surface-side schematic perspective view of the upper-end vicinity of the front-side corrective member and the rear-side corrective member when the two are combined.
Figure 25:
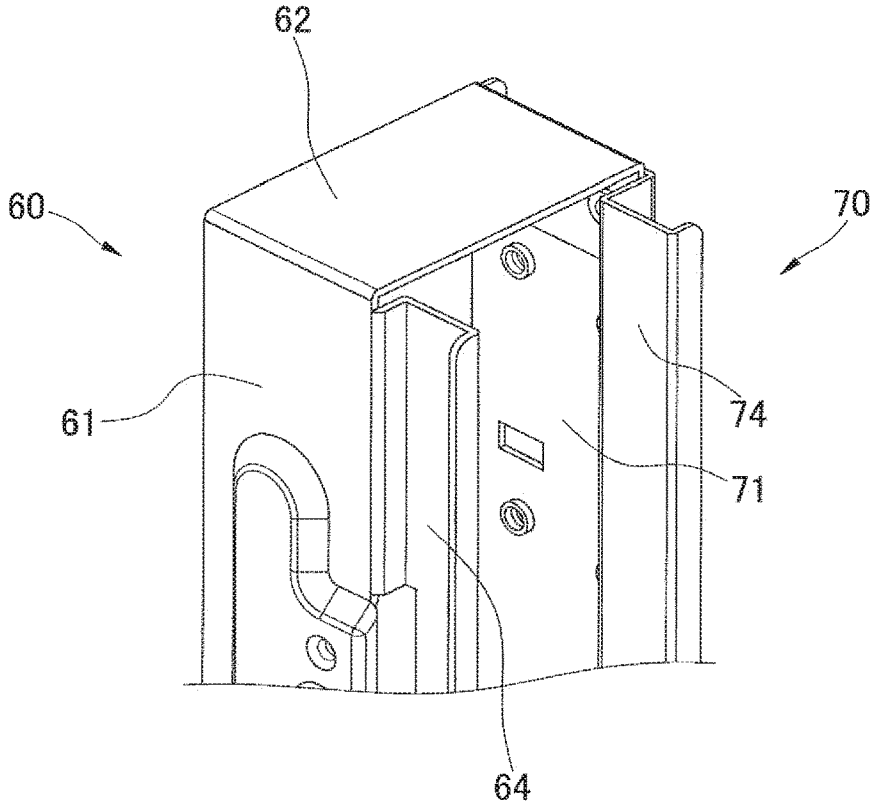
FIG. 25 is a rear-surface-side schematic perspective view of the upper-end vicinity of the front-side corrective member and the rear-side corrective member when the two are combined.

The front-surface-side schematic perspective view of FIG. 24 shows a portion of the upper-end vicinity of the front-side corrective member 70 and the rear-side corrective member 60 when the two are combined. The rear-surface-side schematic perspective view of FIG. 25 shows a portion of the upper-end vicinity of the front-side corrective member 70 and the rear-side corrective member 60 when the two are combined. In FIGS. 24 and 25, the rearward insulative buffer member 86, the forward insulative buffer member 87, and the upper insulative buffer member 88 are omitted.

As described above, the screw hole 71*a* provided in the upper right of the front-side main body part 71 and the screw hole 66*a* provided in the rear-side front surface part 66 of the rear-side corrective member 60 overlap in the front-to-back direction, and the screw hole in the partition panel 18 overlaps as well, in which state the upper portions of the front-side corrective member 70 and the rear-side corrective member 60 are securely fastened by the screw 97.

Figure 26:
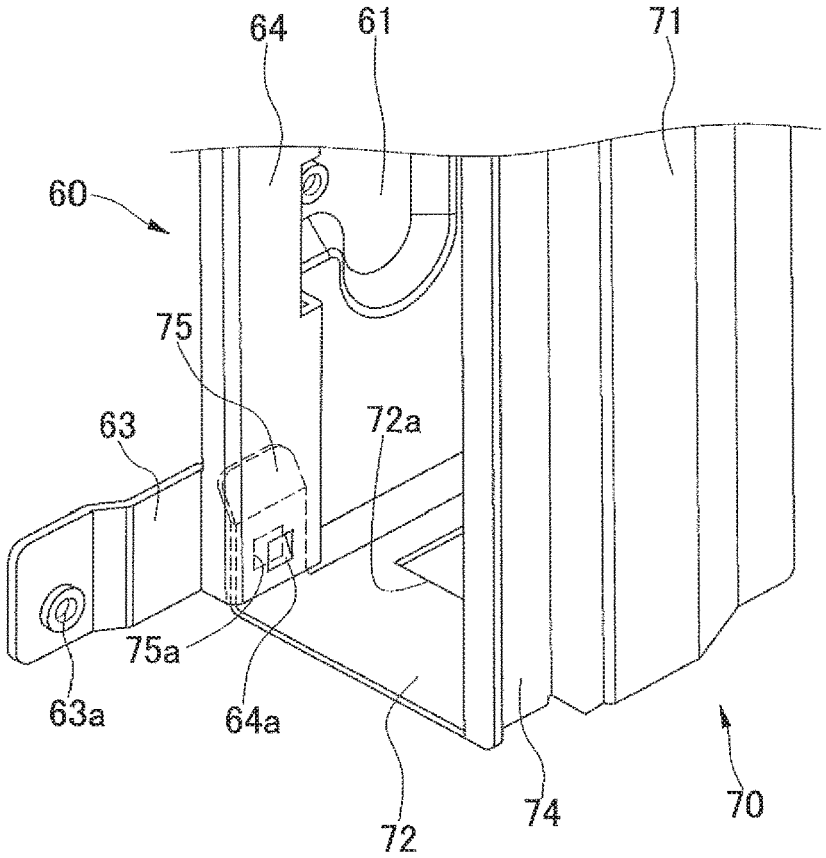
FIG. 26 is a front-surface-side schematic perspective view of the lower-end vicinity of the front-side corrective member and the rear-side corrective member when the two are combined.
Figure 27:
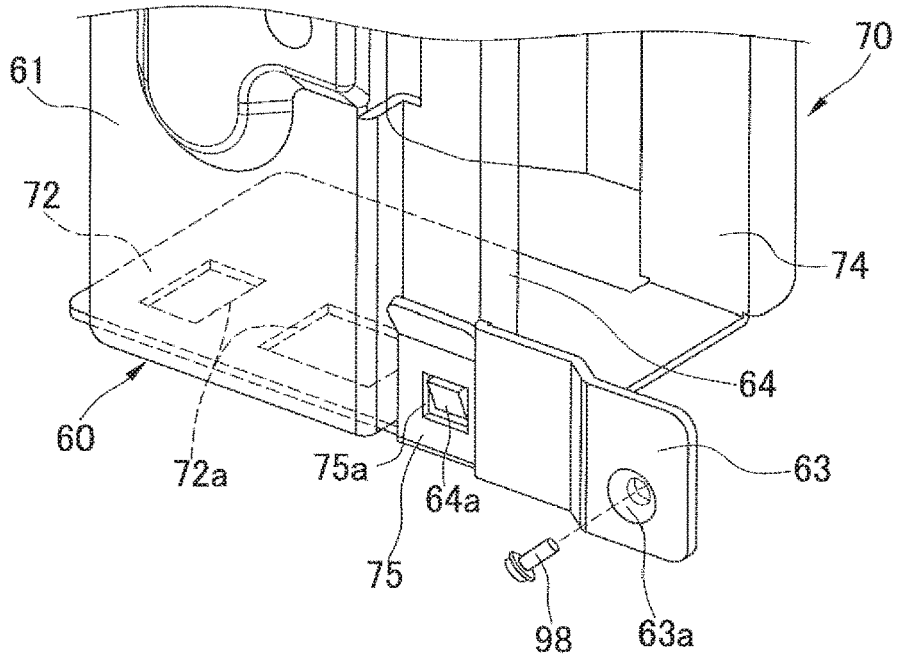
FIG. 27 is a rear-surface-side schematic perspective view of the lower-end vicinity of the front-side corrective member and the rear-side corrective member when the two are combined.

The front-surface-side schematic perspective view of FIG. 26 shows a portion of the lower-end vicinity of the front-side corrective member 70 and the rear-side corrective member 60 when the two are combined. The rear-surface-side schematic perspective view of FIG. 27 shows a portion of the lower-end vicinity of the front-side corrective member 70 and the rear-side corrective member 60 when the two are combined. In FIGS. 26 and 27, the rearward insulative buffer member 86, the forward insulative buffer member 87, and the rubber sheet 80 are omitted.

As described above, the lower portions of the front-side corrective member 70 and the rear-side corrective member 60 are secured by inserting the interlocking pawl 64*a*, which is provided to the lower end of the rear-side convex part 64 of the rear-side corrective member 60, into the securing opening 75*a* formed in the securing wall 75 of the front-side corrective member 70, and interlocking the pawl therein.

Thus, the front-side corrective member 70 and the rear-side corrective member 60, which are secured together in the front-to-back direction, are capable of sandwiching, in the front-to-back direction, the heat transfer fins 21*a* secured to the flat multi-perforated tubes 21*b* in proximity to the folding-back header 24 and/or the outlet/inlet header collecting tube 26 of the outdoor heat exchanger 20, by means of the forward insulative buffer member 87 adhered to the front-side convex part 74 of the front-side corrective member 70 and the rearward insulative buffer member 86 adhered to the rear-side convex part 64 of the rear-side corrective member 60. Thus, the front-side corrective member 70 and the rear-side corrective member 60, which sandwich the outdoor heat exchanger 20 in the front-to-back direction, are both securely fastened to the partition panel 18 and the side-wall portion 12*b* of the bottom frame 12 by the screw 98.

(6) Characteristics of Present Embodiment (6-1)

The heat exchanger assembly 29 of the present embodiment is configured by being sandwiched in the front-to-back direction by the front-side corrective member 70 and the rear-side corrective member 60, via the heat transfer fins 21*a* secured to the flat multi-perforated tubes 21*b* connected to the folding-back header 24 and/or the outlet/inlet header collecting tube 26 of the outdoor heat exchanger 20, and also via the rearward insulative buffer member 86 and/or forward insulative buffer member 87. Particularly, in the present embodiment, sandwiching strength can be increased because the outdoor heat exchanger 20 is sandwiched by the front-side convex part 74 protruding to the rear in the front-side corrective member 70 and the rear-side convex part 64 protruding to the front in the rear-side corrective member 60.

Even if individual differences arise in the flat multi-perforated tubes 21*b* during manufacture and warpage in the outdoor heat exchanger 20 itself occurs when the tubes are combined, this warpage can thereby be suppressed.

Specifically, even if either entire end part in an overhead view of the outdoor heat exchanger 20 becomes warped toward the downstream or upstream side of the air flow from the intended position, this warpage can be suppressed. Additionally, the warpage can be suppressed even when the degree of curvature in the curved part of the outdoor heat exchanger 20 cannot be fully adjusted and the degree of bending is not the intended degree, or when warpage occurs in the outdoor heat exchanger 20 itself due to the center of gravity of the outdoor heat exchanger 20 having deviated from the intended position and the outdoor heat exchanger 20 comes to have an orientation such that either the upper portion is tilted toward the downstream or upstream side of the air flow or the lower portion warps upward toward the downstream or upstream side of the air flow. Such warpage occurs readily particularly when the effective length of flat multi-perforated tubes 21*b* at the same height is designed to be as long as possible in order to expand the region effective for heat exchange (the heat transfer area) in the heat exchanger, or when the heat exchanger is designed so as to have a greater number of vertically aligned flat multi-perforated tubes 21*b*, but warpage in the heat exchanger assembly 29 of the present embodiment can be suppressed even in such cases.

In the present embodiment, the heat transfer tubes of the outdoor heat exchanger 20 are configured by the flat multi-perforated tubes 21*b*, which are obtained by extrusion molding. This manner of flat multi-perforated tubes 21*b* are susceptible to errors during manufacture, and warpage in the outdoor heat exchanger 20 occurs readily. Warpage can be suppressed by employing the heat exchanger assembly 29 of the present embodiment even with the outdoor heat exchanger 20 provided with this manner of flat multi-perforated tubes 21*b*.

Particularly, in the present embodiment, the outdoor heat exchanger 20 has the upstream-side heat exchange part 27 and the downstream-side heat exchange part 28, and is configured having multiple rows from front to back. Therefore, there is a high risk that the upstream-side heat exchange part 27 and the downstream-side heat exchange part 28 will become warped so as to separate from each other. Even in such cases in which the upstream-side heat exchange part 27 and the downstream-side heat exchange part 28 become warped so as to separate from each other, these parts can be sandwiched in the front-to-back direction to suppress warpage in the heat exchanger assembly 29 of the present embodiment.

Additionally, the front-side corrective member 70 and the rear-side corrective member 60 are enclosed from both the front and the back by being secured by the bottom frame 12 and/or the partition panel 18 of the unit casing 10. Therefore, it is possible to stably secure the heat exchanger assembly 29 inside the unit casing 10, and also to dispose the folding-back header 24 and/or the outlet/inlet header collecting tube 26 more easily in the intended positions in the front-to-back direction.

Additionally, because the heat exchanger assembly 29 has already configured a unit sandwiched by the front-side corrective member 70 and the rear-side corrective member 60, the heat exchanger assembly 29 can be attached in a simple manner merely by being fastened by screws to the bottom frame 12 and/or the partition panel 18 of the unit casing 10. Therefore, there is no need for an operation of enclosing the outdoor heat exchanger 20 with corrective members from the vertical direction after installing the outdoor heat exchanger in the unit casing 10.

Additionally, the outdoor heat exchanger 20 is configured from a different type of metal than the front-side corrective member 70 and the rear-side corrective member 60 and there is a risk of electrical corrosion in the event of direct contact, but in the present embodiment, electrical corrosion cam be suppressed because the rubber sheet 80, the rearward insulative buffer member 86, the forward insulative buffer member 87, and the upper insulative buffer member 88, which are configured from an insulative material, are interposed. Moreover, because the rubber sheet 80, the rearward insulative buffer member 86, the forward insulative buffer member 87, and the upper insulative buffer member 88 are all elastic buffer members, it is possible to soften impact between the outdoor heat exchanger 20 and the front-side corrective member 70 and rear-side corrective member 60, and to make sandwiching easier.

(7) Additional Embodiments

The preceding embodiment has been described as one example of embodiment of the present invention, but is in no way intended to limit the invention of the present application, which is not limited to the aforedescribed embodiment. The scope of the invention of the present application would as a matter of course include appropriate modifications that do not depart from the spirit thereof.

(7-1) Additional Embodiment A

In the aforedescribed embodiment, an example was described of a case in which the heat transfer fins 21*a* of the heat exchanger assembly 29 were sandwiched in the front-to-back direction by the rear-side corrective member 60 and the front-side corrective member 70, via the rearward insulative buffer member 86 and/or the forward insulative buffer member 87.

However, it is not only the heat transfer fins 21*a* that may be sandwiched by the rear-side corrective member 60 and the front-side corrective member 70 via the rearward insulative buffer member 86 and/or the forward insulative buffer member 87. For example, the flat multi-perforated tubes 21*b* or other heat transfer tubes may be sandwiched from the front and back, and the folding-back header 24 and/or the outlet/inlet header collecting tube 26, to which the flat multi-perforated tubes 21*b* or other heat transfer tubes are connected, may be sandwiched from the front and back as well.

Furthermore, in cases such as when the front-side end part of the outdoor heat exchanger 20 is configured from heat transfer fins and the rear-side end part is configured from heat transfer tubes, and/or cases in which the front-side end part is configured from heat transfer tubes and the rear-side end part is configured from heat transfer fins, the objects to be supported by the front and rear corrective members (via insulative buffer members) may differ in the front and rear.

(7-2) Additional Embodiment B

In the aforedescribed embodiment, an example was described of a case in which the outdoor heat exchanger 20, configured from aluminum or an aluminum alloy, is sandwiched and supported via the rearward insulative buffer member 86 and/or the forward insulative buffer member 87 by the front-side corrective member 70 and the rear-side corrective member 60, which are configured from a metal having iron as the main component.

Alternatively, the front-side corrective member 70 and the rear-side corrective member 60 may be configured from a metal that suffers substantially no electrical corrosion together with the metal of the outdoor heat exchanger 20, or these three components may be configured by the same type of metal. For example, in cases in which the outdoor heat exchanger 20 is configured from copper and the front-side corrective member 70 and the rear-side corrective member 60 are configured from plated stainless steel having a low iron content, or cases in which both the heat exchanger and the corrective members are configured by the same type of metal, electrical corrosion does not occur readily; therefore, the rearward insulative buffer member 86 and/or the forward insulative buffer member 87 may be omitted and the outdoor heat exchanger may be sandwiched directly from the front and rear.

(7-3) Additional Embodiment C

In the aforedescribed embodiment, an example was described of a case in which the outdoor heat exchanger 20, sandwiched by the front-side corrective member 70 and the rear-side corrective member 60, has the upstream-side heat exchange part 27 and the downstream-side heat exchange part 28 and is configured having multiple rows front to back.

Alternatively, the heat exchanger sandwiched by front-side corrective member 70 and the rear-side corrective member 60 may be configured with one row of heat transfer tubes. Because individual differences could occur during manufacture of the heat transfer tubes even in the case of one row of heat transfer tubes, warpage could occur in the heat exchanger, and this warpage of the one-row heat exchanger can still be suppressed by sandwiching the heat exchanger in between the front-side corrective member 70 and the rear-side corrective member 60.

(7-4) Additional Embodiment D

In the aforedescribed embodiment, an example was described of a case in which the rubber sheet 80, the rearward insulative buffer member 86, the forward insulative buffer member 87, and the upper insulative buffer member 88 are all configured from a material that have both an insulative function and a buffering function.

Alternatively, when, for example, the outdoor heat exchanger 20, the front-side corrective member 70, and the rear-side corrective member 60 are configured from a metal that is not likely to suffer electrical corrosion, conductors having a buffering function may be interposed therebetween. When the buffering function become not particularly necessary due to, inter alia, the shapes of the outdoor heat exchanger 20, the front-side corrective member 70, and the rear-side corrective member 60, members made of glass or the like, having an insulative function but not a buffering function, may be interposed therebetween.

REFERENCE SIGNS LIST

1 Air conditioning apparatus (refrigeration apparatus)
2 Air conditioning outdoor unit (outdoor unit)
3 Air conditioning indoor unit
10 Unit casing (casing)
12 Bottom frame (casing)
12*a* Bottom portion
12*b* Side-wall portion

12*x* Water-draining port
12*y* Water-draining surface
13 Side panel at the blower chamber side
14 Side panel at the machinery chamber side (casing, interposed member)
15 Blower chamber-side front panel
18 Partition panel (interposed member)
20 Outdoor heat exchanger (heat exchanger)
21 Heat exchange part
21*a* Heat transfer fins (fins, sandwiched objects)
21*b* Flat multi-perforated tubes (heat transfer tubes, flat tubes, sandwiched objects)
22 Diverter
23 Connecting header
24 Folding-back header (header, sandwiched object)
25 Interconnecting part
26 Outlet/inlet header collecting tube (header, sandwiched object)
27 Upstream-side heat exchange part (first-row heat transfer tube group)
28 Downstream-side heat exchange part (second-row heat transfer tube group)
29 Heat exchanger assembly
37 Front-side spacer
38 Corner spacer
39 Rear-side spacer
60 Rear-side corrective member (first corrective member)
61 Rear-side main body part
62 Rear-side top surface part
63 Rear-side securing part (securing part)
63*a* Screw hole (securing part)
64 Rear-side convex part (convex part, warpage-suppressing portion)
64*a* Interlocking pawl
66 Rear-side front surface part
66*a* Screw hole
70 Front-side corrective member (second corrective member)
71 Front-side main body part (securing part)
71*a* Screw hole (securing part)
72 Front-side bottom part
72*a* Bottom-part openings
74 Front-side convex part (convex part, warpage-suppressing portion)
75 Securing wall
75*a* Securing opening
80 Rubber sheet (buffer member)
81 Water-draining openings
86 Rearward insulative buffer member (buffer member, insulative member)
87 Forward insulative buffer member (buffer member, insulative member)
88 Upper insulative buffer member (buffer member, insulative member)

CITATION LIST

Patent Literature

<Patent Literature 1>Japanese Laid-open Patent Application publication No. 2010-169357

What is claimed is:

1. A heat exchanger assembly comprising:
a header extending in a longitudinal direction;
a plurality of heat transfer tubes aligned along the longitudinal direction of the header and connected to the header;
a plurality of fins secured to the heat transfer tubes;
a first corrective member extending along the longitudinal direction of the header on a downstream side of the heat transfer tubes or the header along a direction of an air flow; and
a second corrective member extending along the longitudinal direction of the header on an upstream side of the heat transfer tubes or the header along the direction of the air flow,
the first and second corrective members having first and second lengths respectively, measured in the longitudinal direction,
a sandwiched object, which is at least any one of the heat transfer tubes, the fins, and the header, being sandwiched by the first corrective member and the second corrective member,
the first and second lengths being longer than a length of the sandwiched object measured in the longitudinal direction, and
the first and second corrective members being separate members releasably directly secured to each other via first and second end portions of the first corrective member in the longitudinal direction of the first and second corrective members and
first and second end portions of the second corrective member in the longitudinal direction of the first and second corrective members.

2. The heat exchanger assembly according to claim 1, further comprising:
a buffer member, at least part of the buffer member being at least one of interposed between the first corrective member and the sandwiched object, and
interposed between the second corrective member and the sandwiched object.

3. The heat exchanger assembly according to claim 2, wherein
the first corrective member and the second corrective member are formed from a metal different than a metal used for the sandwiched object, and
the buffer member is insulative.

4. The heat exchanger assembly according to claim 3, wherein
the heat transfer tubes include a first-row heat transfer tube group and a second-row heat transfer tube group disposed so as to be aligned in a front-to-back direction, and
the first corrective member and the second corrective member cooperate so as to suppress front-to-back-direction separation between the first-row heat transfer tube group and the second-row heat transfer tube group.

5. The heat exchanger assembly according to claim 3, wherein
the heat tubes are flat tubes.

6. The heat exchanger assembly according to claim 2, wherein
the heat transfer tubes are flat tubes.

7. The heat exchanger assembly according to claim 2, further comprising:
an insulative member, at least part the insulative member being at least one of interposed between the first corrective member and the sandwiched object, and
interposed between the second corrective member and the sandwiched object,
the first corrective member and the second corrective member being formed from a metal different than a metal used for the sandwiched object.

8. The heat exchanger assembly according to claim 2, wherein the heat transfer tubes include a first-row heat transfer tube group and a second-row heat transfer tube group disposed so as to be aligned in a front-to-back direction, and the first corrective member and the second corrective member cooperate so as to suppress front-to-back-direction separation between the first-row heat transfer tube group and the second-row heat transfer tube group.

9. The heat exchanger assembly according to claim 1, further comprising:

an insulative member, at least part the insulative member being at least one of interposed between the first corrective member and the sandwiched object, and interposed between the second corrective member and the sandwiched object, the first corrective member and the second corrective member being formed from a metal different than a metal used for the sandwiched object.

10. The heat exchanger assembly according to claim 9, wherein the heat transfer tubes include a first-row heat transfer tube group and a second-row heat transfer tube group disposed so as to be aligned in a front-to-back direction, and the first corrective member and the second corrective member cooperate so as to suppress front-to-back-direction separation between the first-row heat transfer tube group and the second-row heat transfer tube group.

11. The heat exchanger assembly according to claim 9, wherein the heat transfer tubes are flat tubes.

12. The heat exchanger assembly according to claim 1, wherein the heat transfer tubes include a first-row heat transfer tube group and a second-row heat transfer tube group disposed so as to be aligned in a front-to-back direction, and the first corrective member and the second corrective member cooperate so as to suppress front-to-back-direction separation between the first-row heat transfer tube group and the second-row heat transfer tube group.

13. The heat exchanger assembly according to claim 12, wherein the heat transfer tubes are flat tubes.

14. The heat exchanger assembly according to claim 1, wherein the heat transfer tubes are flat tubes.

15. The heat exchanger assembly according to claim 1, wherein the first end portions of the first and second corrective members are secured by inserting an interlocking-portion of the first corrective member into a securing opening of the second corrective member.

16. The heat exchanger assembly according to claim 15, wherein a fastener secures the second end portions of the first and second corrective members, the second end portions of the first and second corrective members being longitudinally spaced from the first end portions of the first and second corrective members.

17. An outdoor unit of a refrigerating apparatus, the outdoor unit comprising:

a heat exchanger assembly including a header extending in a longitudinal direction, a plurality of heat transfer tubes aligned along the longitudinal direction of the header and connected to the header, a plurality of fins secured to the heat transfer tubes, a first corrective member extending along the longitudinal direction of the header on a downstream side of the heat transfer tubes or the header along a direction of an air flow, and a second corrective member extending along the longitudinal direction of the header on an upstream side of the heat transfer tubes or the header along the direction of the air flow, the first and second corrective members having first and second lengths respectively, measured in the longitudinal direction, a sandwiched object, which is at least any one of the heat transfer tubes, the fins, and the header, being sandwiched by the first corrective member and the second corrective member, the first and second lengths being longer than a length of the sandwiched object measured in the longitudinal direction, and the first and second corrective members being separate members releasably directly secured to each other via first and second end portions of the first corrective member in the longitudinal direction of the first and second corrective members and first and second end portions of the second corrective member in the longitudinal direction of the first and second corrective members; and a casing having a bottom frame and accommodating the heat exchanger assembly, at least one of the first corrective member and the second corrective member being secured to the bottom frame, either directly or indirectly, via an interposed member in order to secure the heat exchanger assembly to the casing.

18. An outdoor unit of a refrigerating apparatus, the outdoor unit comprising:

a heat exchanger assembly including a header extending in a longitudinal direction, a plurality of heat transfer tubes aligned along the longitudinal direction of the header and connected to the header, a plurality of fins secured to the heat transfer tubes, a first corrective member extending along the longitudinal direction of the header on a downstream side of the heat transfer tubes or the header along a direction of an air flow, and a second corrective member extending along the longitudinal direction of the header on an upstream side of the heat transfer tubes or the header along the direction of the air flow, the first and second corrective members having first and second lengths, respectively, measured in the longitudinal direction a sandwiched object, which is at least any one of the heat transfer tubes, the fins, and the header, being sandwiched by the first corrective member and the second corrective member, the first and second lengths being longer than a length of the sandwiched object measured in the longitudinal direction, and the first and second corrective members being separate members releasably directly secured to each other via first and second end portions of the first corrective member in the longitudinal direction of the first and second corrective members and first and second end portions of the second corrective member in the longitudinal direction of the first and second corrective members; and a casing accommodating the heat exchanger assembly, the first corrective member and the second corrective member having a warpage-suppressing portion arranged to sandwich the sandwiched object, the warpage-suppressing portion having a convex part that protrudes toward the sandwiched object, and a securing part arranged to secure the first corrective member and the second corrective member to a secured part, the secured part being either the casing or an interposed member secured to the casing.

* * * * *